United States Patent [19]

Hamelin

[11] Patent Number: 4,817,797

[45] Date of Patent: Apr. 4, 1989

[54] CLOSED PACKAGE WITH A COMPOSITE BINDING MEMBER/HANDLE AND A GRASPING CAVITY

[75] Inventor: Benoît Hamelin, Breuschwickersheim, France

[73] Assignee: Brasseries Kronenbourg, Strasbourg, France

[21] Appl. No.: 876,475

[22] Filed: Jun. 20, 1986

[30] Foreign Application Priority Data

| | | | |
|---|---|---|---|
| Jun. 21, 1985 | [FR] | France | 8509603 |
| Dec. 16, 1985 | [FR] | France | 8518743 |
| Dec. 16, 1985 | [FR] | France | 8518744 |

[51] Int. Cl.[4] ..... B65D 65/00

[52] U.S. Cl. ..... 206/428; 206/427; 229/52 B; 229/52 BC

[58] Field of Search ..... 206/427, 428, 139; 229/40, 41 C, 109, 52 B, 52 BC

[56] References Cited

U.S. PATENT DOCUMENTS

| | | | |
|---|---|---|---|
| 2,001,478 | 5/1935 | Vogt | 229/109 |
| 2,925,213 | 2/1960 | Zukoski | 229/41 C |
| 3,066,795 | 12/1962 | Mansfield . | |
| 3,310,219 | 3/1967 | Dlugopolski | 229/52 B |
| 4,301,922 | 11/1981 | Hamelin et al. | 229/52 BC |
| 4,362,265 | 12/1982 | Williams | 229/109 |
| 4,382,511 | 5/1983 | Hamelin et al. | 206/427 |
| 4,715,493 | 12/1987 | Dreyfus | 206/200 |

FOREIGN PATENT DOCUMENTS

| | | | |
|---|---|---|---|
| 7511852 | 11/1975 | France . | |
| 2302244 | 9/1976 | France | 206/427 |
| 7825707 | 3/1980 | France . | |
| 680779 | 1/1965 | Italy | 229/109 |

*Primary Examiner*—David T. Fidei

*Attorney, Agent, or Firm*—Schwartz & Weinrieb

[57] ABSTRACT

Closed package with a composite binding member/handle and a grasping cavity.

A closed composite package with a peripheral binding member for the presentation for sale of a product sensitive to light, characterized in that the body (1) of the package is formed behind the peripheral belt (12), at free end locations resulting from quincuncial arrangemnt of the containers, in accordance with a receiving cavity (24) which is formed by the enveloping of the adjacent lateral surfaces of the end containers; the cavity has different heights depending on the shape and the dimensions of the containers; the bottom (2) is attached to the body (1), on the one hand, by one or two gluing strips (3) and (4) or (101) and, on the other hand, by central strips (10) and (11) or (92) possibly joined to the bottom of the cavity (24) by auxiliary holding strips (95) and (96).

This invention is of a particular interest to producers of beverages or of foods with a guaranteed vitamin contents and sold in transparent wrappings, and to makers of packaging machines.

17 Claims, 21 Drawing Sheets

1
12
13
15
16
21
22
23
24
25
26
27
28
29
30
31
32
33
34
35
36
41
42
45
46
47
48
49
50
53

CLOSED PACKAGE WITH A COMPOSITE BINDING MEMBER/HANDLE AND A GRASPING CAVITY

The above invention relates to a closed package with a peripheral binding member serving as a handle and a grasping cavity in front of which the binding member passes with an improved handle regardless of the type of containers.

All producers of beverages or other high consumption products seek to utilize to the best the surface of the pallets employed for the handling and presentation for sale in supermarkets and shopping malls.

To augment the rate of space occupation there is an interest, starting with a certain number of grouped objects, in disposing the containers in quincunxes, in spite of the formation of free spaces at one or the other end or at both ends simultaneously. In effect, the rate of space occupation of the useful surface thus increases in correlation to the reduction of the width of the grouping together with the overlapping of the edges of the containers disposed in quicunxes.

On the other hand, the necessity of wrapping in closed packages results in two principal imperatives. First the protection from light is indispensable for numerous beverages. This obligation is apparent even more rigorously for products sold in transparent containers which, after a long exposure to light acquire a light-related taste which is particularly disagreeable. This obligation appears also as fundamental for products having guaranteed vitamin contents sensitive to the light, such as vitamin B2.

Furthermore, the growing number of shop-liftings in the shopping malls has caused management to demand from the manufactures packages that are entirely closed and stay closed even after the package is picked up for purchase.

In fact, the purchaser should not be able to hide any objects whatsoever in a package until it has been passed through the check-out counter As a matter of fact, any package of this type that has been damaged becomes suspect provoking, in turn, systematically complete inspection of its interior at the time of payment therefor.

On the other hand, concerning the means for the improvement of the rigidity and cohesion of the grouping or regrouping, there has already been used a peripheral encircling on the outside of the packaging carton to immobilize the containers in the interior of a closed package or with a continuing simple lateral surface (French patent LAFARGE Package No. 2.302.244), but also for immobilizing the only lateral panels of a package with an upper lateral end surface which opens around a grouping of containers (French patent TETRA PAK No. 2.149.899).

There has also been tried the possibility of utilizing the peripheral binding member as a handle by association of the latter with deformable notches bringing about, as the consumer picks the package up, the formation of an arrow which sufficiently disengages the binding member at the lateral end surface in order to assure the passage of the hand (French patent KRONENBOURG No. 2.434.763).

In the present invention, it is attempted to have the peripheral binding member fully assume the role of an encircling member extending over the package, and at the same time, through suitable structures, allow its direct and easy usage by the consumer as a handle.

A secondary object of the present invention consists in the realization of packages of two different materials, the first for the bottom, which is configured in a manner resembling a small boat, being corrugated cardboard of the type including microchannels which does not have to be imprinted and brings about rigidity and absorption of vertical shocks in the pallets between the bottoms of the bottles and the stoppers of the subjacent layer, the second of printed kraft cardboard of minimal resistance for the rest of the package, in which the cohesion of the grouping is ensured only by the binding member.

The object of the invention is to fulfill these three conditions simultaneously in a package with a peripheral encirclement by a binding member and offering a remarkable facility of grasping the binding member used as a handle in the central part of at least one of the lateral end faces.

In order to accomplish this, the general inventive idea consists in using one or more recesses at the end of a row of a quincuncial arrangement of containers in a closed package with a peripheral binding member so as to constitute means for the guidance and the passage of the hand through the frontal plane of the package, in order to facilitate the grasping of the binding member.

More precisely, the general inventive idea consists, for a larger number of grouped bottles, in increasing the width of the cavity by an arrangement of associated quincunxes in order to render the width of the opening of the receiving end cavity closer to that of an adult hand, keeping in mind the usual diameters of small bottles.

With respect to the means, the invention relates to a package closed with a peripheral binding member which plays the role of a handle at least at one of the ends, characterized in that a body of the package forms at the free end location or locations obtained from the quincuncial arrangement, a receiving cavity behind the binding member, which is used for the passage of the hand and the gripping of the binding member for the purpose of holding, displacing and carrying the package; the above package may be erected into a receptacle and it benefits from a raised bottom cavity.

Many of the numerous advantages of the closed package according to the invention will be mentioned below:

- savings in the cost of printing and cutting;
- noticeable saving of cardboard;
- easy holding of the binding member and easy carrying of the package;
- maximum utilization of the surface for transportation support and presentation for sale;
- complete protection from the light;
- easy opening of the upper access traps due to the possibility of using a cardboard with lower resistance;
- good cohesion of the grouping of bottles;
- mechanical protection of the stoppers during manipulation of the pallets;
- possibility of adaptation to bottles with strong conicity by raising the cavity;
- the utilization of a receptacle shape by providing a simple supplementary groove.

The technical characteristics and other advantages of the invention are outlined in the description which is accomplished by virtue of a non-limiting example in four basic implementations with reference to the accompanying drawings in which.

Four basic implementations of a closed package according to the invention are shown in FIGS. 1 to 13 to illustrate the inventive concept. A plurality of variations is also described below. It is understood that many implementations derived from the same general inventive idea are also possible. They cannot all be described, but some are sufficiently suggested by the following description or can be derived from the information provided here.

As was already indicated above, the general inventive idea resides in the utilization of end recesses of a quincuncial arrangement of containers disposed in several rows to constitute at a circumferential periphery of a closed package a receiving end cavity which has a sufficient space for the passage of a hand in order to grasp a binding member across the frontal plane of the cavity, and to use it as a handle.

More particularly, the width of the receiving cavity is augmented in the large models by an arrangement in a double quincuncial grouping, which makes it equal or close to the average hand size of an adult.

Figure 10:
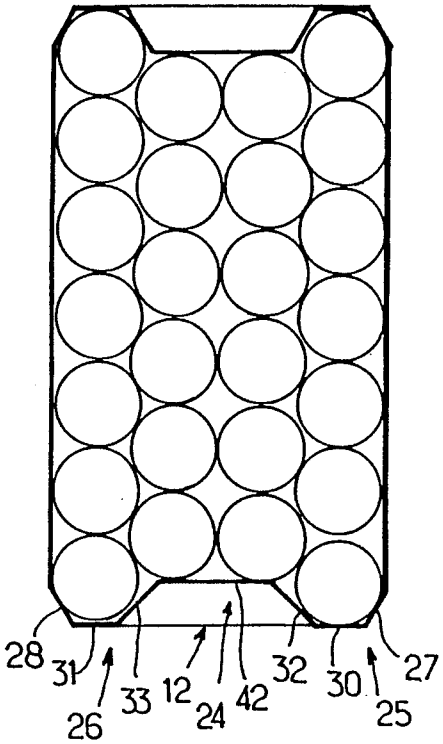
FIGS. 9 and 10 are two schematic plan views illustrating two typical examples of the quincuncial distribution of bottles utilized for medium-sized and large groupings.
Figure 9:
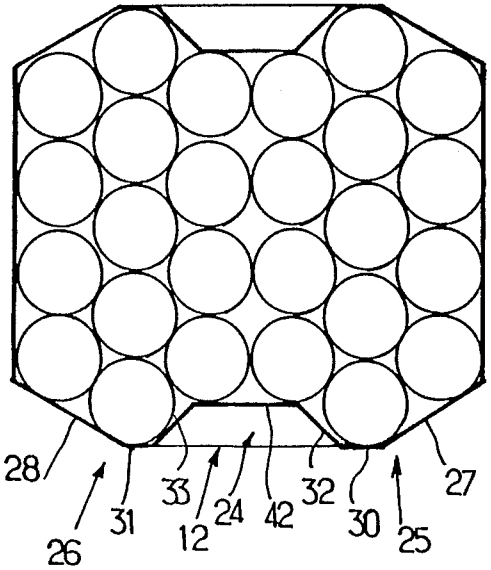

The package according to the invention is applied to at least three different types of quincuncial arrangements: a first type having a longitudinal configuration including three rows (FIG. 3) for a small grouping of bottles: eight, eleven, fourteen, seventeen, and two supplementary arrangements in a quincuncial juxtaposition (FIGS. 9 and 10). The first, in a wide configuration, is a juxtaposition of two quincunxes including three rows for larger groupings of bottles: twenty, twenty-six, thirty-two . . . , and a second narrow configuration is a juxtaposition of two quincunxes including two rows for groupings of eighteen twenty-two, twenty-six, thirty . . .

The technical shapes of the blanks of the ends, of the bottom and of the end panels described below are also applicable when the bottom is separated as well as when the bottom is attached to a top, that is, in the latter case, a one-piece flat blank.

The characteristics common to four implementations of the bottom of the small model and of the three large models in the narrow or wide configuration in a two-piece version will be examined first.

The package according to the invention is composed of a package body 1 and of a bottom 2 to which the body 1 of the package is joined by gluing.

The bottoms 2 comprise, for this purpose, lateral flaps 3 and 4 serving as gluing tabs. The transverse edges 5 of the bottom are provided with semi-curved or broken-line cutout portions 6 and 7 for the small model, and 8 and 9 for the large model according to the particular end configuration. These cutout portions are separated by a central flap forming an end gluing tab 10 or 11, respectively, for the small and the large models.

The bottoms are made of corrugated cardboard having microchannels oriented perpendicularly to the lateral flaps 3 and 4 to provide a good overall rigidity and the desired folding facility. Moreover, transverse impacts on the package will be better absorbed because the channels provide a improved resistance in this manner.

The choice of the corrugated cardboard results from the necessity to offer mechanical resistance. It is left in its rough state for reasons of economy; the economy is even better because the bottom does not require any printing.

The top of the package, which has been called the body 1, is made of an imprintable kraft cardboard. It includes a peripheral binding member 12 of the flat type, for example a polypropylene strap which has a slight elasticity on pulling.

This binding member and the fact that it surrounds the exterior of the package assures a true encirclement of the grouping of bottles, giving it all of the necessary cohesive strength; this is further improved by the quincuncial arrangement and the rigidity of the bottom. With that, the resistance of the imprintable kraft cardboard constituting the top can be reduced, and can be chosen to be minimal.

The packages include on the upper surface 13 or 14 pre-cut access traps 15 and 16 for the small model, and 17 and 18 for the large models. These traps, which have conventional characteristics, are opened by a complete detachment on the small model and have a double articulated recessed fold 19 and 20 on the large models, permitting the folding of the trap lid behind the binding member. Furthermore, in all cases, there remains a sufficient material edge portion around the traps to keep sufficient rigidity when the package is open.

The general shapes of the packages are determined by the shape of the grouping or groupings of bottles.

Conventionally, the package comprises lateral panels 21 and 22 joined to the top surface 13 or 14 by oblique longitudinal cut sections, such as 23. These cut sections are repeated at the transverse ends of the package, as will become apparent below.

Of course, these will not exist in the case of cylindrical containers.

The small model will now be examined in more detail with reference to FIGS. 1 to 6.

Figure 3:
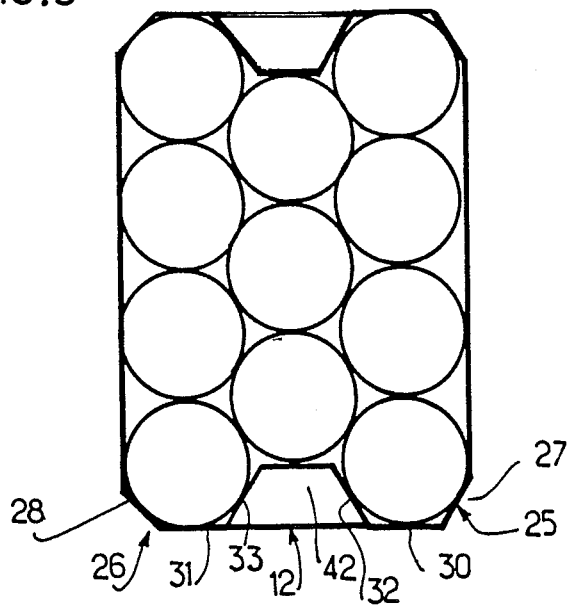
FIG. 3 is a schematic plan view illustrating the distribution of bottles in the small model of the package according to the invention.
Figure 4:
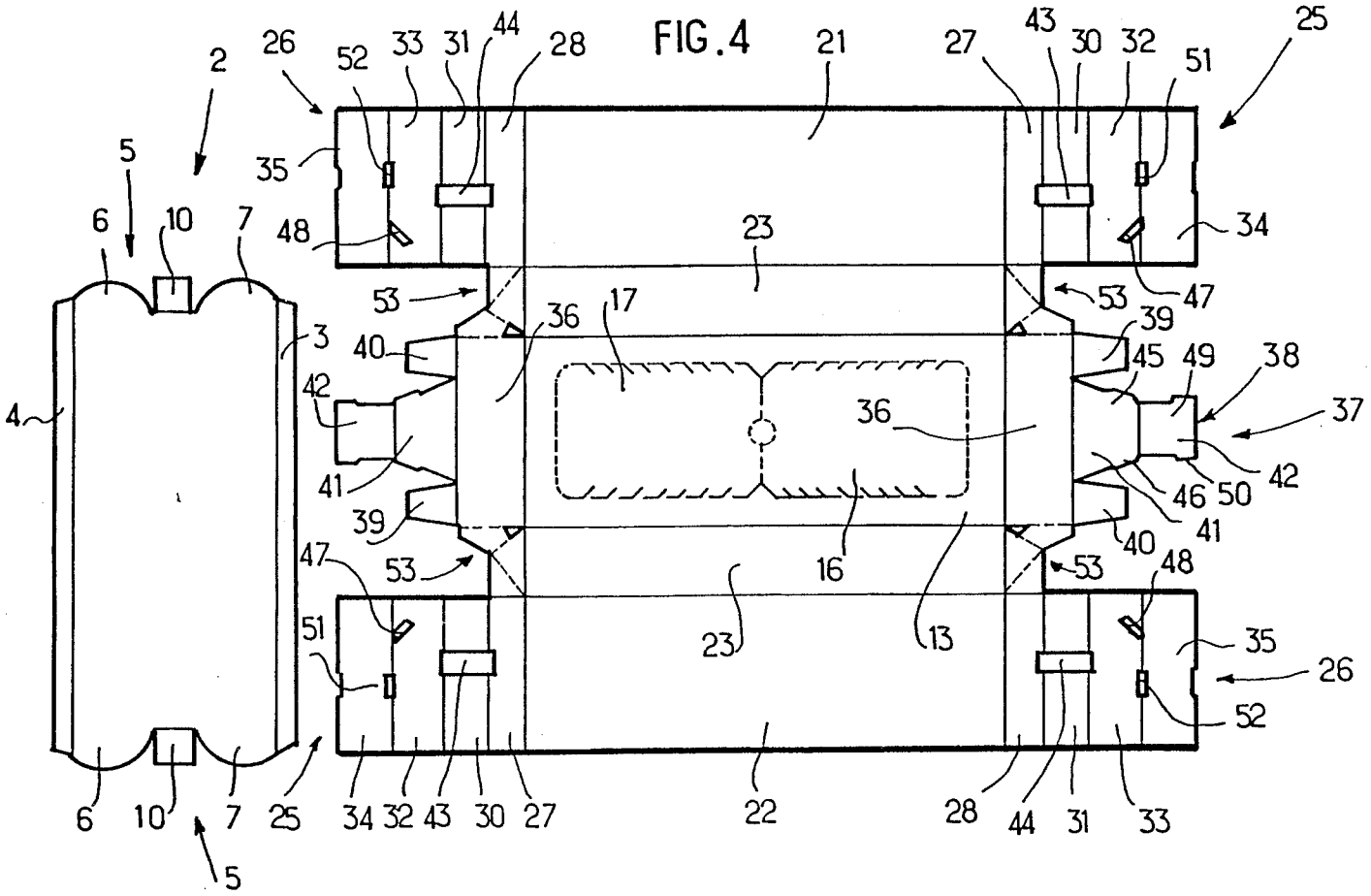
FIG. 4 is a plan view of the developed blanks of the body of the package illustrated in FIG. 1 and of the corresponding bottom.

The small model is of a simple grouping. The distribution of the containers represented in FIG. 3 shows three rows arranged in a quincunx. The center row has a lesser number of containers, providing free space at each of the ends. In a compact version, it would be possible to place one extra bottle at one of the ends, the disadvantage being that a rounded protuberance has to be covered with an end panel so that the stability of the package in a standing position is no longer assured.

According to the invention, the free end space is formed in the package in the shape of a receiving cavity 24 which is set back with respect to the frontal end plane; the cavity is utilized as an access space for the grasping of the binding member permitting the passage of the hand behind the binding member and its gripping for the realization of the function of a handle.

More precisely, the end structures of the small model are composed of the following means.

Generally, the package has at least one end forming the receiving cavity 24 which is set back behind a binding member 12 crossing the frontal end plane. The enveloping of the end bottles at one and the other side of the central recess and that from the inside of the receiving cavity 24 are achieved by a succession of flaps and tabs which are immobilized by covering and gluing.

The end is made of three tabs, namely two lateral tabs 25 and 26 which are each connected by a respective vertical oblique section 27 and 28 to a vertical panel of a corresponding lateral surface and a top tab such as 29 which are superimposed to form in a folded state the complete end of the package and thus constitute the receiving cavity 24. An identical cavity is formed at the opposite end, when the package is symmetrical.

The lateral end tabs 25 and 26 include three vertical panels arranged in series, being separated by parallel grooves. It has, from the center towards the outside, as seen on the developed blank, panels 30 or 31 of the small end surface defining the frontal plane of the package, two lateral cut sections 32 or 33 forming the vertical lateral walls of the cavity 24, and two vertical panels 34 or 35 of the bottom of the cavity which, on the one hand, are applied over and united by gluing to the central flap 10 or 11 of the bottom 2 and, on the other hand, form, by a cover, the bottom wall of the cavity 24.

The upper flap 29 constitutes a connection with the upper surface and forms an upper inclined part of the cavity 24. It comprises a cut oblique overlapping section 36 constituting an inclined plane, which is extended in a central part 37 by a small immobilizing tongue 38 and on each side by two lateral gluing strips 39 and 40 covered by the panels 30 and 31 of the small end surface.

The immobilizing tongue 38 is made of a first blocking flap 41 having a trapezoidal shape, followed by a locking flap 42 having a rectangular shape, which is glued to one or the other panel 34 and 35 of the bottom of the cavity. These flaps respectively form the upper part and a part of the bottom of the cavity 24, and assure the holding of the adjacent panels.

The binding member 12 is put around the package along a plane perpendicular to the generatrices of the bottles, preferably at a plane of gravity of the grouping of bottles when carried horizontally. The binding member simultaneously fulfills two functions: when tightened, it assures the cohesion of the grouping, and plays the role of a handle.

In order to attain this, it is maintained in the plane defined above by simple rectangular horizontal notches 43 and 44 which are cut out in the panels of the small end surface; the cutouts are extended on both sides to the adjacent panels to give the notches sufficient depth.

To facilitate the setting and the good centering of the end pieces with respect to one another at the time of the mounting and gluing, there have been provided on the first blocking flap 41 lateral centering tongues 45 and 46 cooperating with corresponding oblique notches 47 and 48 made in the two lateral cut sections 32 and 33. Other lateral tongues 49 and 50 are further provided at the end of the locking flap 42, for becoming engaged in the corresponding vertical notches 51 and 52 cut out at the separation region of the cut lateral sections 32 and 33 and of the panels 34 and 35 of the bottom of the cavity.

Compensation notches are further provided on free vertical edges of the panels 34 and 35.

The upper tab 29 is laterally articulated to the upper horizontally and vertically cut joining sections by a set of corner articulations 53 constituted by three small panels having generally triangular shapes and forming a hollow trihedral pyramid in the assembled package.

During the formation of the cavity, the upper tab 29 is lowered and the immobilizing tongue 38 is raised while the lateral tabs remain open. The latter are then flipped over, accompanied by the gluing of the strips 39 and 40 as well as the gluing of the central bottom strip 10 or 11. The immobilizing tongue is therefore only flipped over and definitely put in position by a gluing effectuated simultaneously with the engagement of the lateral tongues into the corresponding notches. The formation of the receiving cavity is thus completed and the cavity is maintained in place.

The particular characteristics of the first two large models will now be examined with references to FIGS. 7 to 10.

These large groupings are made of juxtapositions of quincuxes of two or three rows of containers.

In the case of a simple longitudinal grouping, such as that depicted in FIG. 10, the general shapes of the packages are identical to those of the small model already described above. The receiving cavity which has a larger width offers more space and therefore comfort to the hand of the consumer for holding the binding member.

On the other hand, the implementation having the juxtaposition of two quincuxes including three rows as shown in FIG. 9, presents a general hexagonal shape which is entirely original.

This particular implementation of the large model of the package, according to the invention, has a widened symmetrical shape having a cavity with a double width, caused by the presence of two groupings having three rows of containers. This type of a arrangement enables the grouping in one package of larger numbers of containers which differ from each other by six units. In practice, the numbers of twenty, twenty-six and thirty-two can be attained.

In conformity with the general inventive idea, the spaces corresponding to the end locations are converted in the package into receiving cavities formed in the body of the package itself by an association of panels of flaps and of gluing strips.

The elements which have identical shapes and functions carry the same reference numerals.

The vertical panels 21 and 22 of the lateral surface are extended by the vertical oblique sections 27 and 28 and the lateral flaps 25 and 26 of the same type which are formed by the three serial panels.

In order to save on cardboard, the ends of these lateral tabs 25 and 26 are situated at the same transverse line as that of the end of the immobilizing central tongue 38. Consequently, and because of the large width of the package, the bottom panels 34 or 35 of the cavity are no longer covered. Their free edge, consequently, no longer requires the presence of any compensation notch, and the locking flap 42 is simultaneously glued to the panels 34 and 35.

All of the vertical oblique sections 27 and 28 are joined to the upper surface 14 by cut corner sections 54 and 55 on which the folding lines 56 are inclined at a 60° angle with respect to the lines of the bottles, connected, at each side, with the adjacent oblique panels by a bellows-type articulation 57.

Each corner cut section 54 or 55 is extended toward the corresponding vertical oblique section 27 or 28 by a gluing strip 58 or 59.

Because of the increased length of the vertical oblique sections 27 and 28, a horizontal supplementary notch 60 or 61 is necessary to assure the sufficient holding of the binding member. It extends parallel to the groove which separates the adjacent panel 21 or 22 of the lateral surface from the corresponding vertical oblique section 27 or 28.

Figure 6:
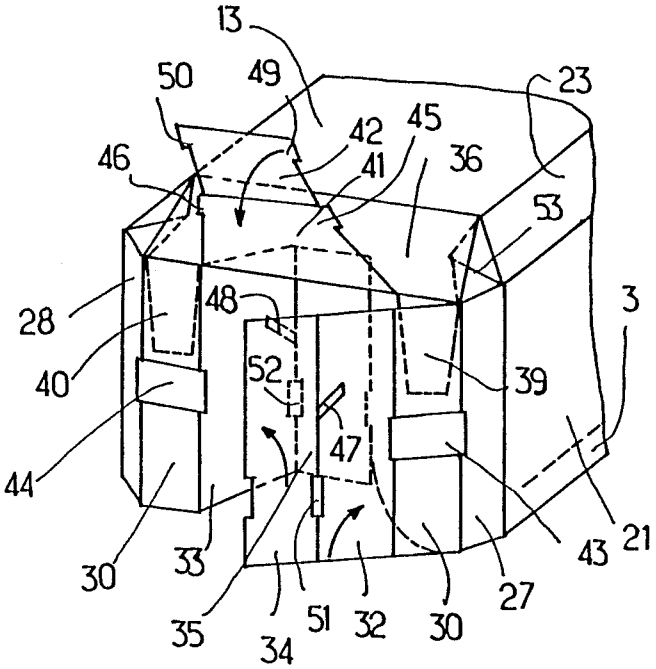
FIGS. 5 and 6 are perspective views of the end structures, illustrating two characteristic phases of closure at the time of fabrication.
Figure 5:
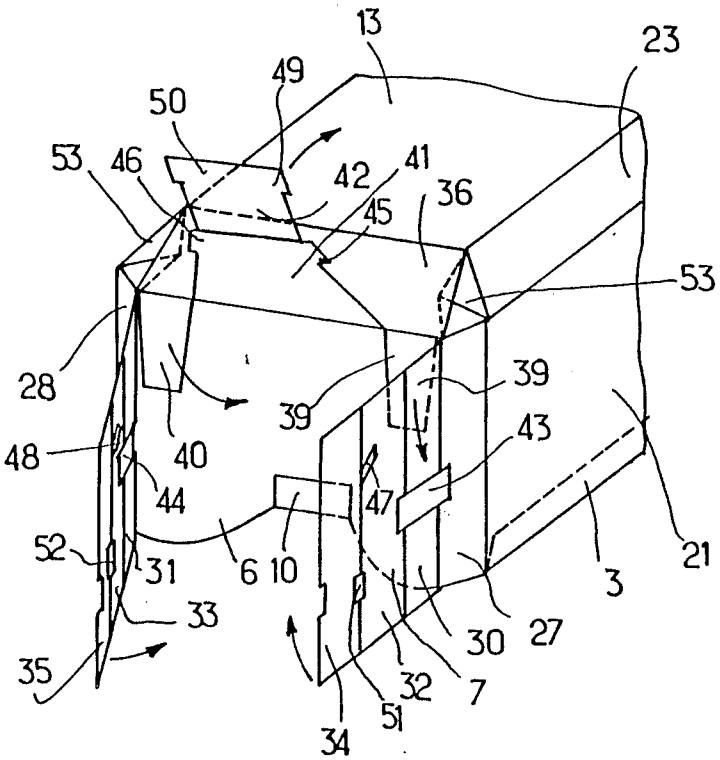
Figure 7:
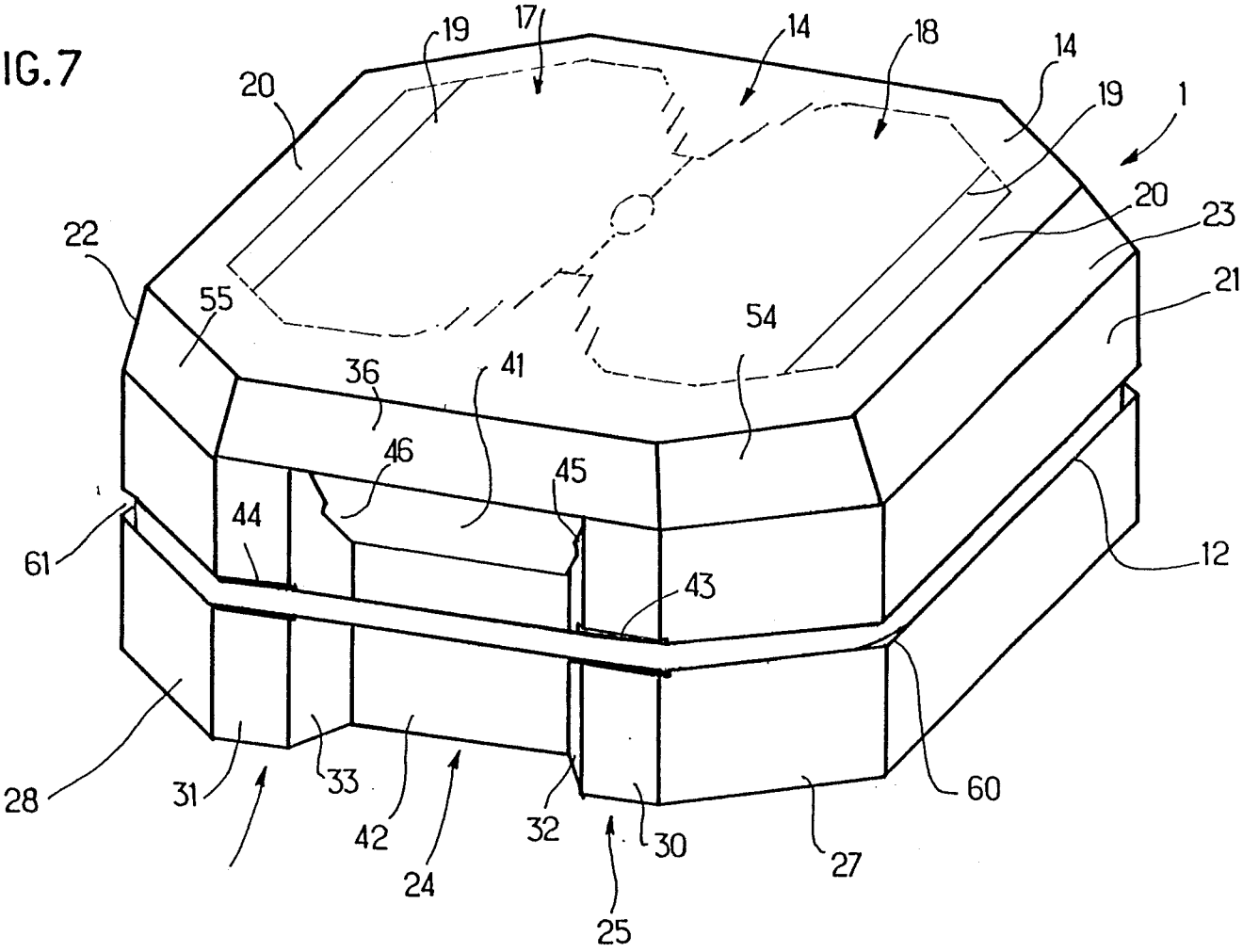
FIG. 7 is a perspective view of an implementation corresponding to an example of a large model of the package according to the invention.
Figure 8:
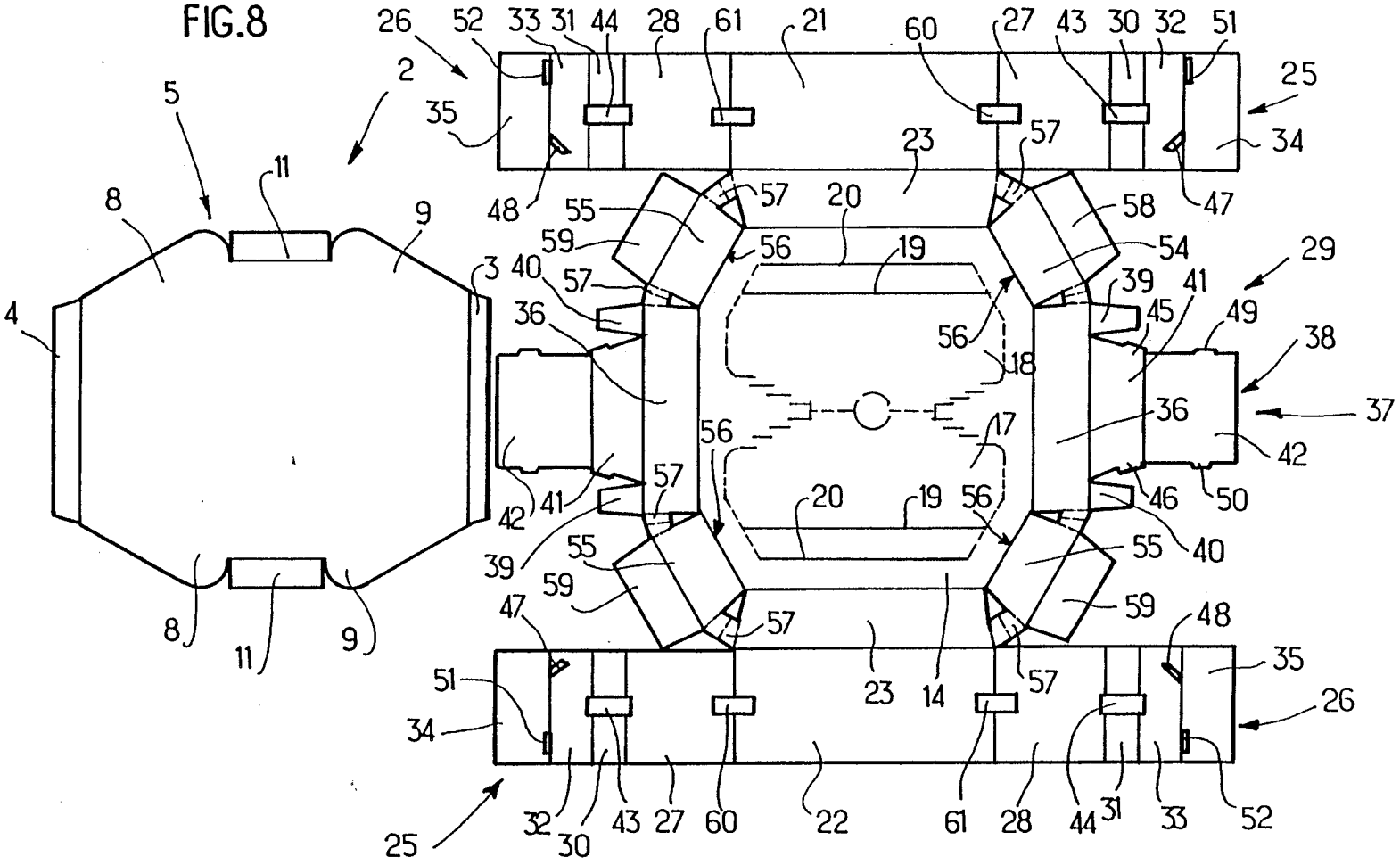
FIG. 8 is a plan view of the developed blanks of the body of the package and of the corresponding bottom of the example of the large model illustrated in FIG. 7.

The formation of the package is accomplished as previously by the gluing of the lateral flaps 3 and 4 of the bottom to lower edges of the vertical panels 21 and 22 of the lateral surface, simultaneously with the lowering of the corner cut sections 54 and 55 on the one hand, and 36 on the other hand, while the immobilizing tongue 38 is maintained in its raised position. Then the lateral tabs are pushed towards the free space and then the gluing of the strips 58 and 59 to the adjacent vertical oblique sections 27 and 28 follows, followed, in turn, by the gluing of the lateral strips 39 and 40 of the upper tab 29, while the immobilizing tongue 38 still remains raised. The vertical panels 34 and 35 of bottom of the cavity are then glued to the bottom central flap 11. The immobilizing tongue is then flipped down, put into place, glued and locked by the interaction of the lateral tongues and the secondary notches as shown in FIGS. 5 and 6.

Figure 11:
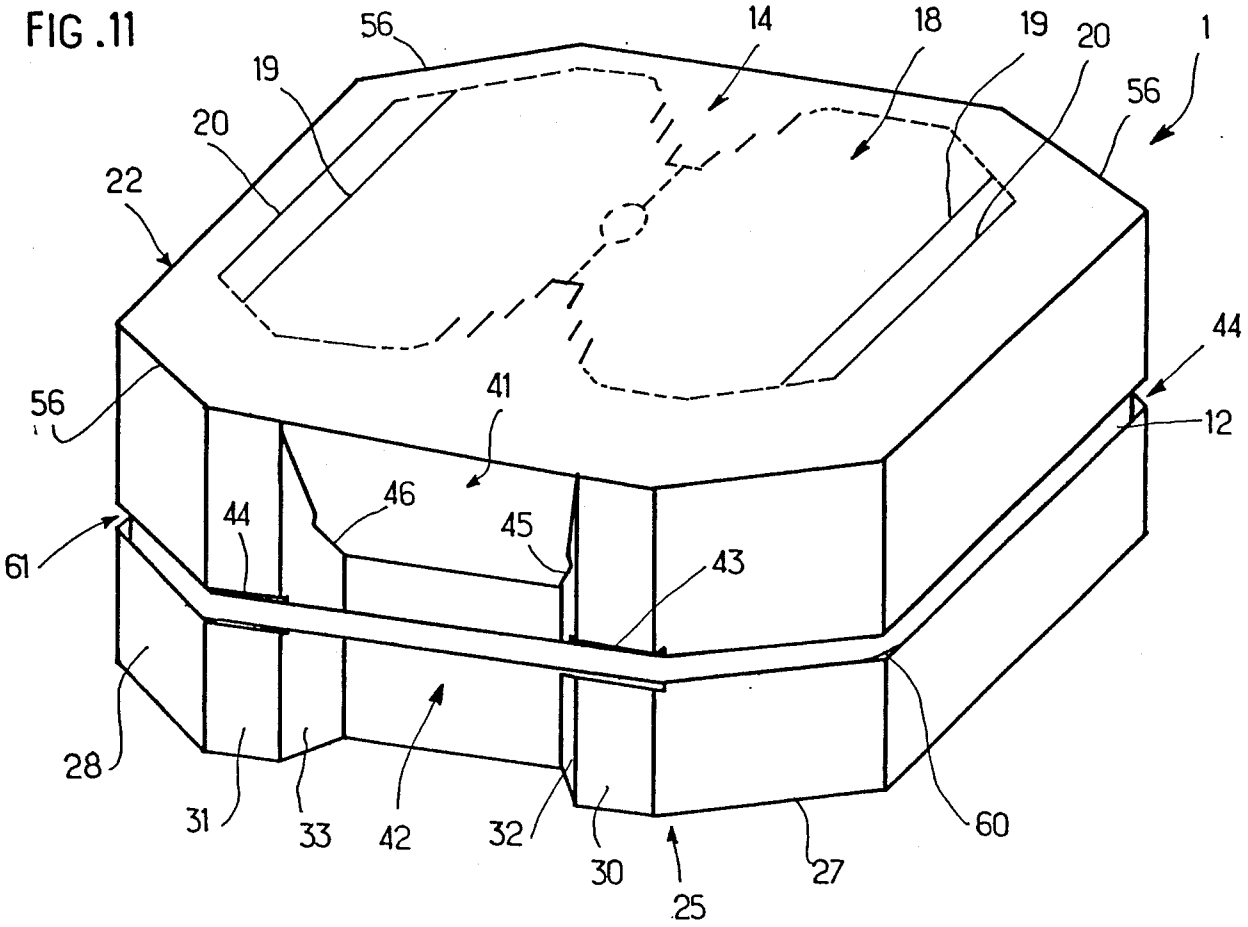
FIG. 11 is a perspective view of another implementation of a large model of the package according to the invention.
Figure 12:
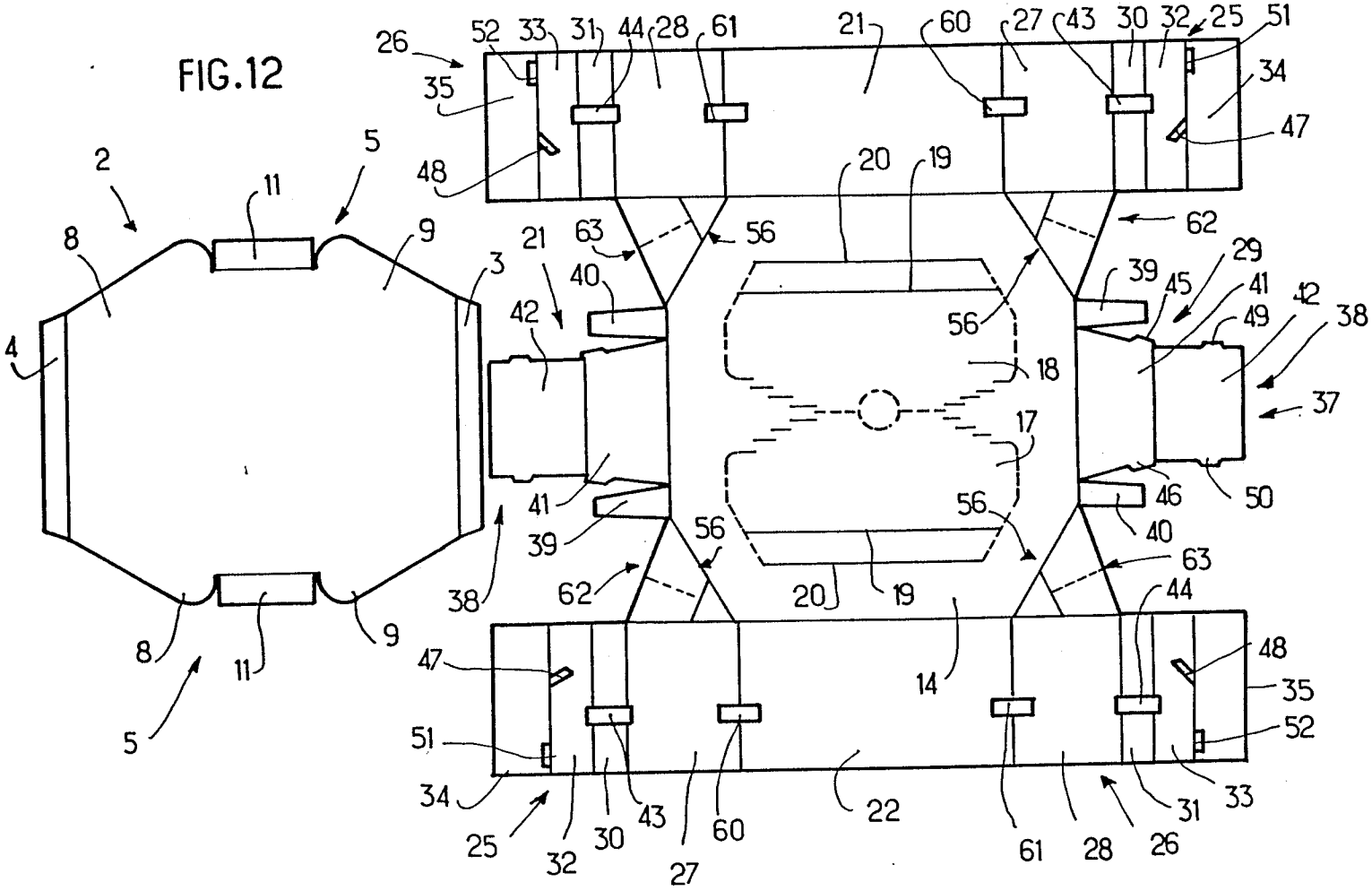
FIG. 12 is a plan view of the developed blanks of the body of the package and of the corresponding bottom of the example of the large model illustrated in FIG. 11.
Figure 14:
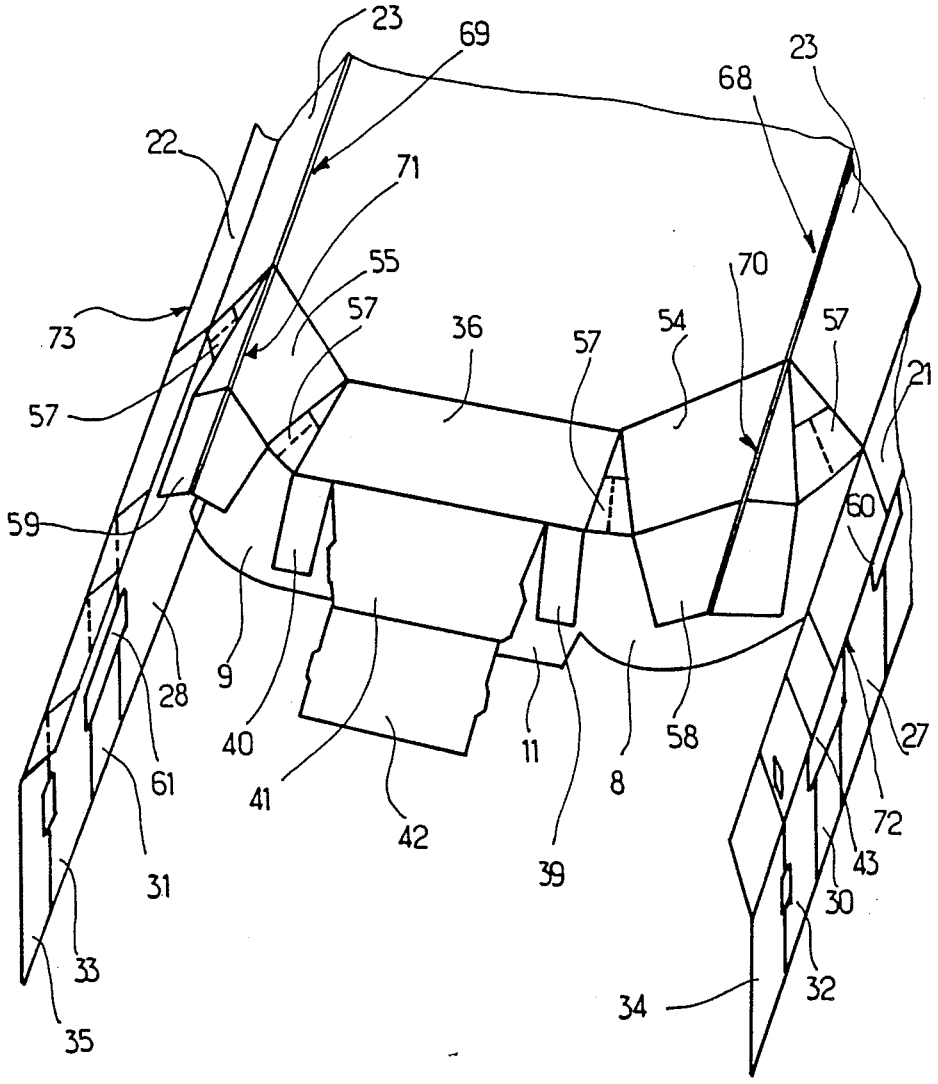
FIG. 14 is a perspective view of a forward part of the erected or receptacle implementation of FIG. 7, which is partially erected into a receptacle.
Figure 15:
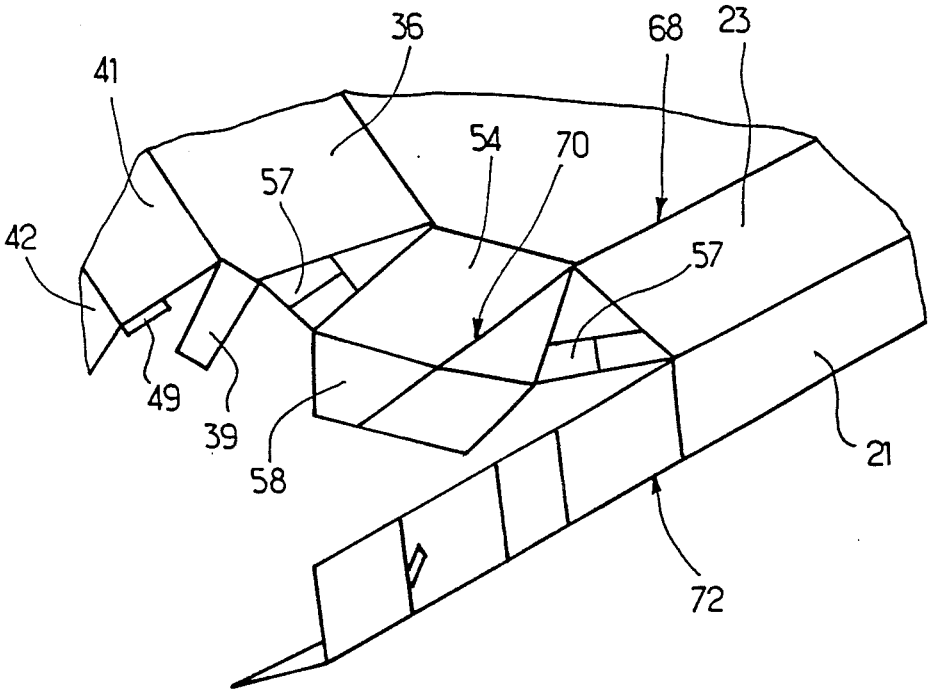
FIG. 15 is a detailed perspective view of a zone adjoining a cut corner section in an erected position.
Figure 16:
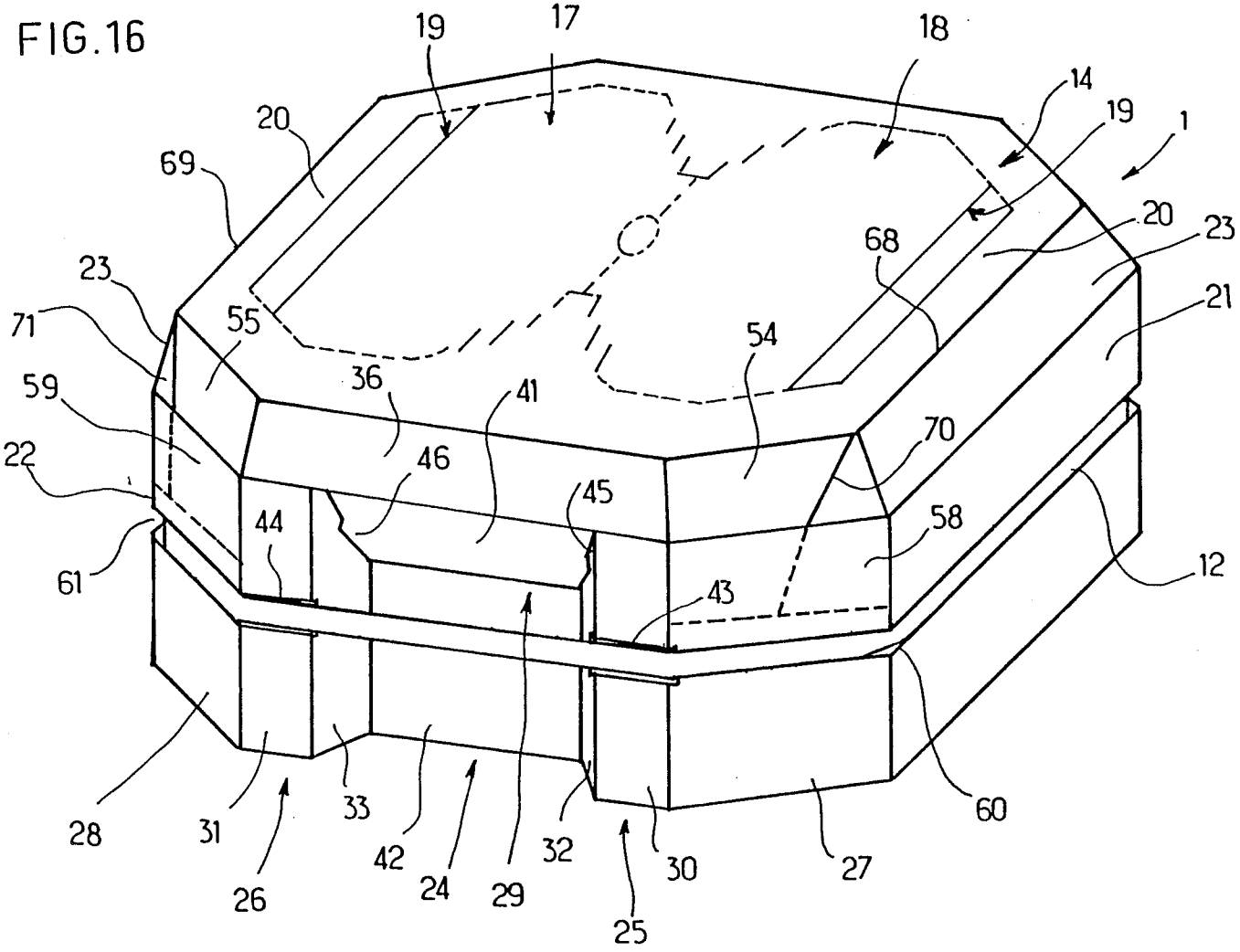
FIG. 16 is a perspective view of an assembled implementation of FIG. 7 in its receptacle version.

A variant illustrated in FIGS. 11 and 12 no longer possesses the upper oblique longitudinal sections or the corners and, therefore, it is better adapted for cylindrical containers or those having a pronounced conicity, for the reason in the former case, of gaining volume and, in the latter case, of the displacement of the plane of gravity towards the top and, consequently, the approach of the binding member to the upper wall of the receiving cavity, which proportionately reduces the entry section.

The main idea of this variant consists of gaining room towards the top in order to leave a passage section sufficient for the hand of the consumer and, therefore, guaranteeing the maintenance of comfort when being used.

This implementation differs slightly from the first large model in its shape as well as in its characteristics. The vertical panels 21 and 22 of the lateral surface follow each other towards the top up to the upper surface 14, having a configuration which is identical in shape to that of the large model, but having a larger surface This will permit the provision of larger traps in order to facilitate access to the bottles.

The first blocking panel 41 of trapezoidal shape will therefore have its surface augmented in the upward direction. The lateral gluing strips 39 and 40 have increased length.

The joining of the corners of the upper surface 40 to the vertical cut sections 27 and 28 is accomplished in this case by a simple bellows 62 and 63, which is incorporated in the package at the time of its mounting, possibly using a drop of immobilizing glue between the two flaps of the bellows.

It will be the same for the small model which can present this general shape by omitting all of the upper longitudinal or lateral oblique sections.

Figures 1, 2:
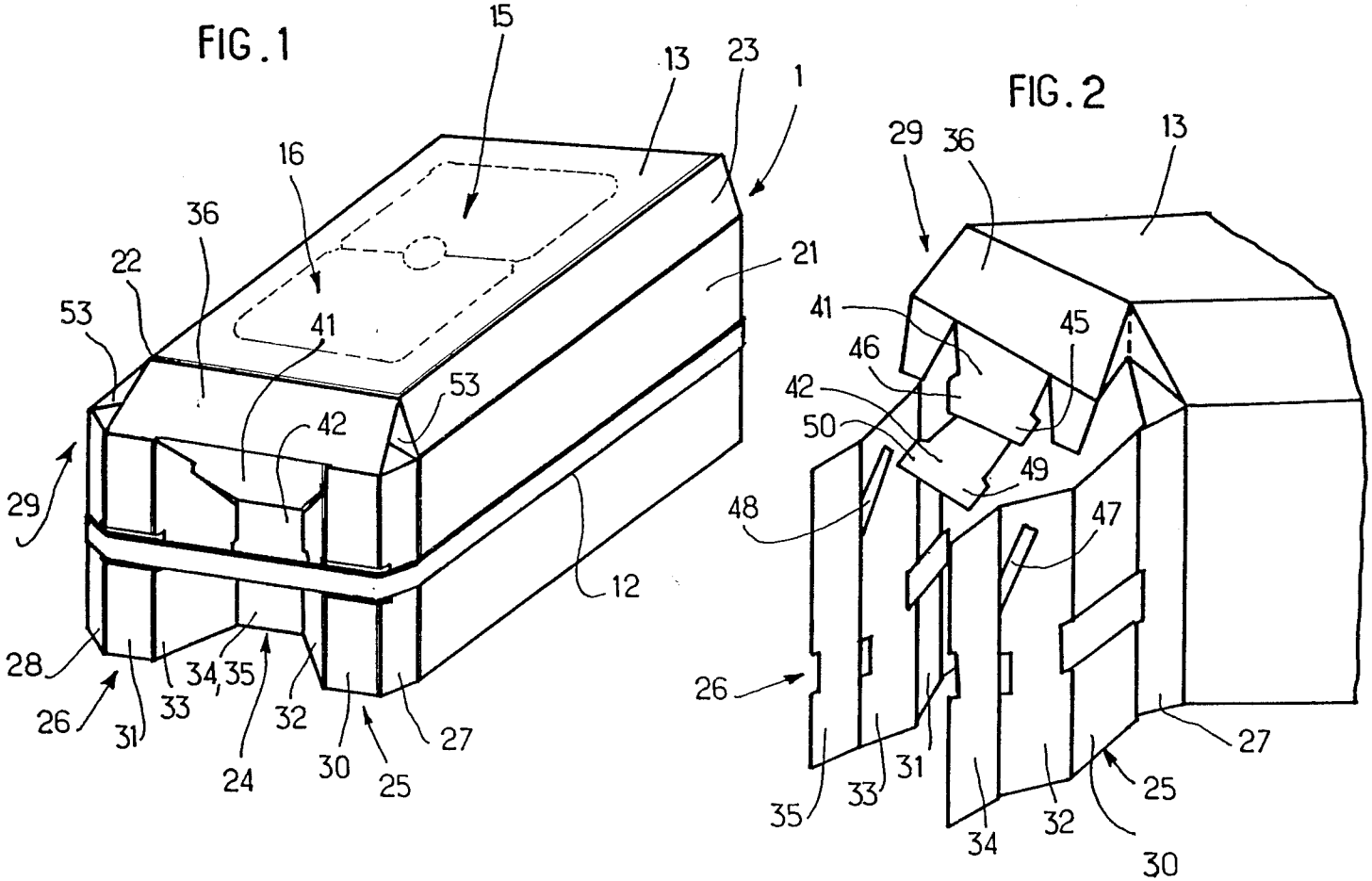
FIG. 1 is a perspective view of a first implementation intended for a small model of the package according to the invention.
FIG. 2 is a perspective view of one of the ends in an open and unfolded state.
Figure 13:
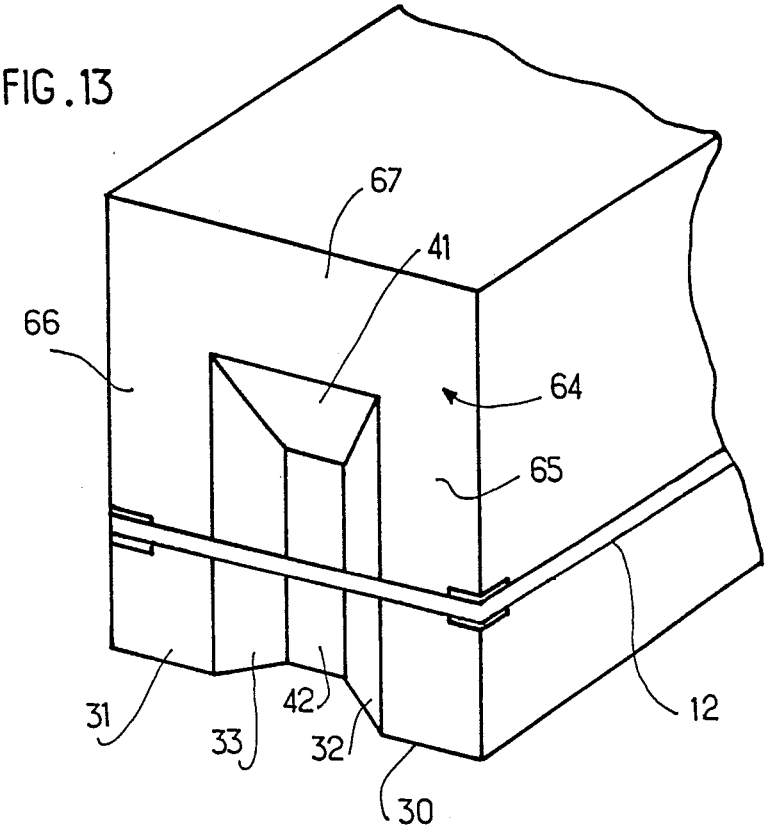
FIG. 13 is a perspective view of a supplemental implementation of a large or a small model of the package according to the invention.

A supplementary example of a small or large model showing the general means of the invention is shown in FIG. 13. It again possesses the essential characteristics of the other models without the vertical cut sections 27 and 28 and without the upper oblique circumferential panels, the two independent lateral gluing tongues being advantageously in this case replaced by a unique frontal panel 64 with vertical lateral elongations 65 and 66, all flipped on top of and glued to the vertical panels 30 and 31 of the small end surfaces. A central part 67 of this panel, in this case, ensures the joining between the upper surface 14 and the trapezoidal blocking flap 41, the latter constituting, as in the other models, the upper surface of the receiving cavity 24.

The general inventive idea has been illustrated above in many implementations. It is understood, however, that a diverse direct variants, modifications of secondary order, substitutions by equivalent means, joinder(s) of inoperative element(s) and other changes without inventive addition are obvious from the spirit of the present invention and are perfectly included in its framework.

This would be the case, for example, if the vertically cut panels at the four corners were dispensed with and replaced by a unique vertical ridge associated with a notch for holding the binding member which completely passes therethrough.

This would also be the case if the longitudinal oblique cut sections, or the end oblique cut sections, or both, were dispensed with. In the latter case, the upper panel would be directly connected, on one hand, to the vertical lateral surfaces and, on the other hand, to the lateral gluing tongues connected to the end lateral panels and finally to the trapezoidal panel forming the upper surface of the end receiving cavity.

With respect to the type of means used for manufacturing this package, it should be suitable to erect the package as a receptacle or as a casing into which the grouping of containers is introduced.

This type of a variant will be described below in a two piece version, realizing that it can also be applied to a one piece version. The following description is effected by taking as an example the basic implementation in FIG. 7 adapted for the receptacle mode and illustrated in FIGS. 14 through 17.

The described characteristic improves the manner of erecting the package and shaping it for the quick and easy constitution of a receptacle or a casing with glue pre-applied , because the joining force of the walls would not permit, without the following characteristic, to correctly raise the corner cut sections and the center panels of the front surface to easily permit the grouping of the containers in the internal space, because of the complexity of the flaps, the panels and bellows of the front surface.

According to this characteristic, the upper grooves 68 and 69, which separate the upper surface from the longitudinal oblique cut sections are prolonged at various parts across the corner cut sections 53 and 54 and their gluing strips 58 and 59, respectively, by segments 70 and 71 so as to constitute a continuing folding line parallel to the other folding lines present on the lateral surfaces, and permitting the erection the package into a receptacle or a casing.

This groove, which continues over the entire length of the package, permits, owing to the semi-rigidity of the upper surface, to raise, by joint movement, the central succession of the tabs and flaps of the frontal surface to release, by lateral pressure, the opening of the casing in a sufficient section to ensure the mechanization of the admission of a grouping of the containers into the internal free space after the package has been formed as a receptacle or a casing.

Figure 17:
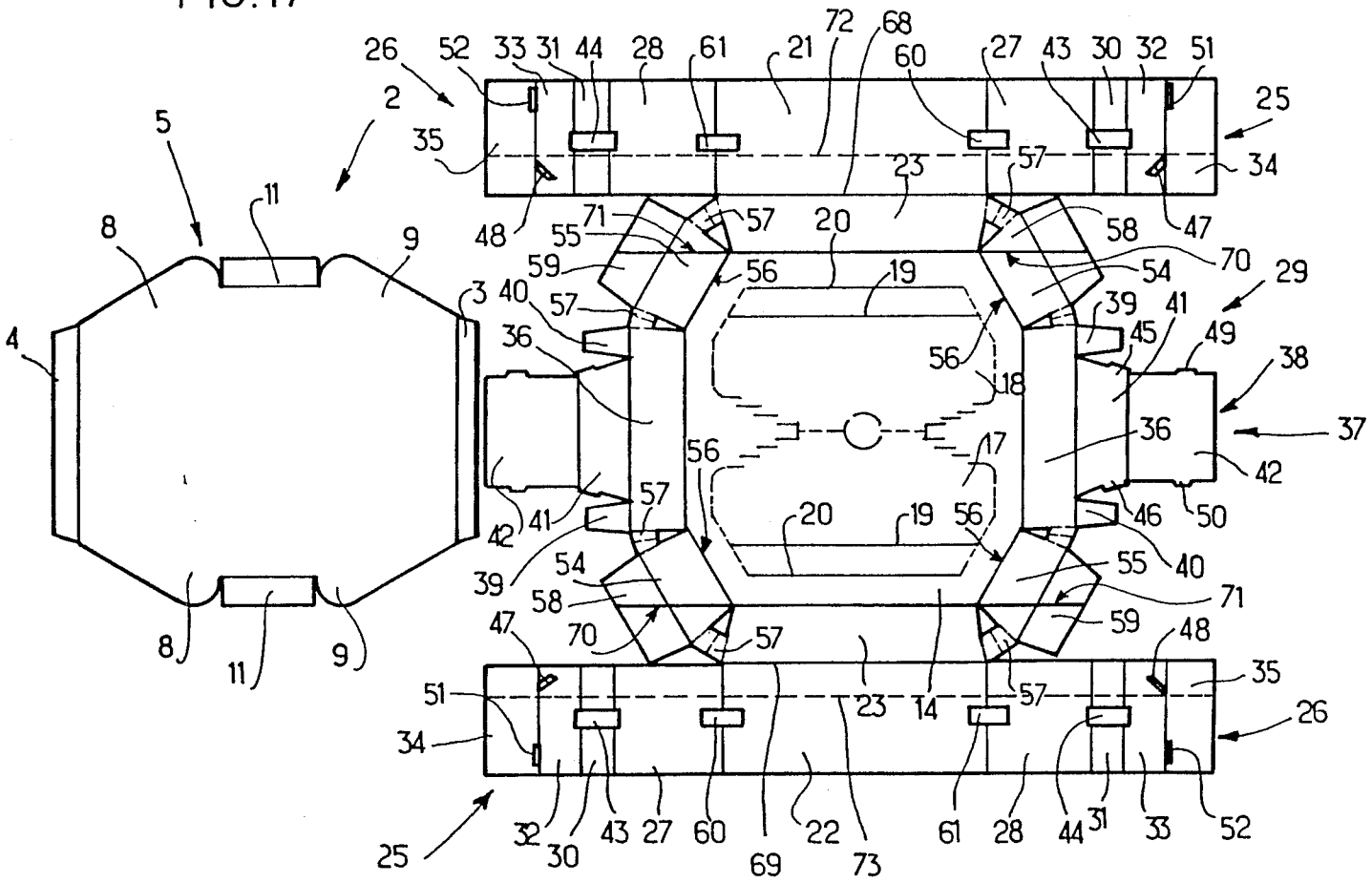
FIG. 17 is a plan view of the printing blank of and of the corresponding separate bottom.
Figure 18:
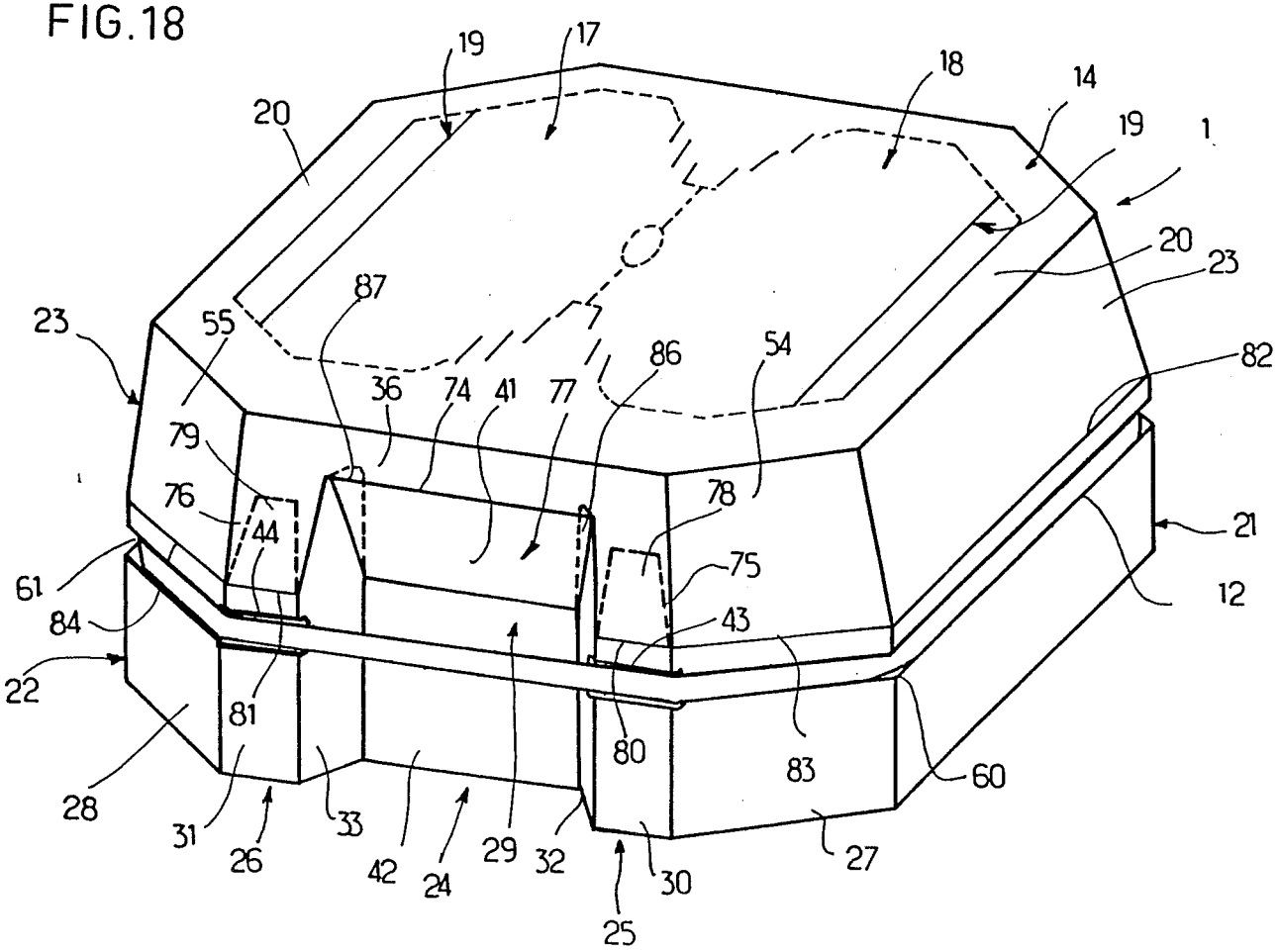
FIG. 18 is a perspective view of an implementation of FIG. 7 in accordance with a version with a raised cavity.
Figure 19:
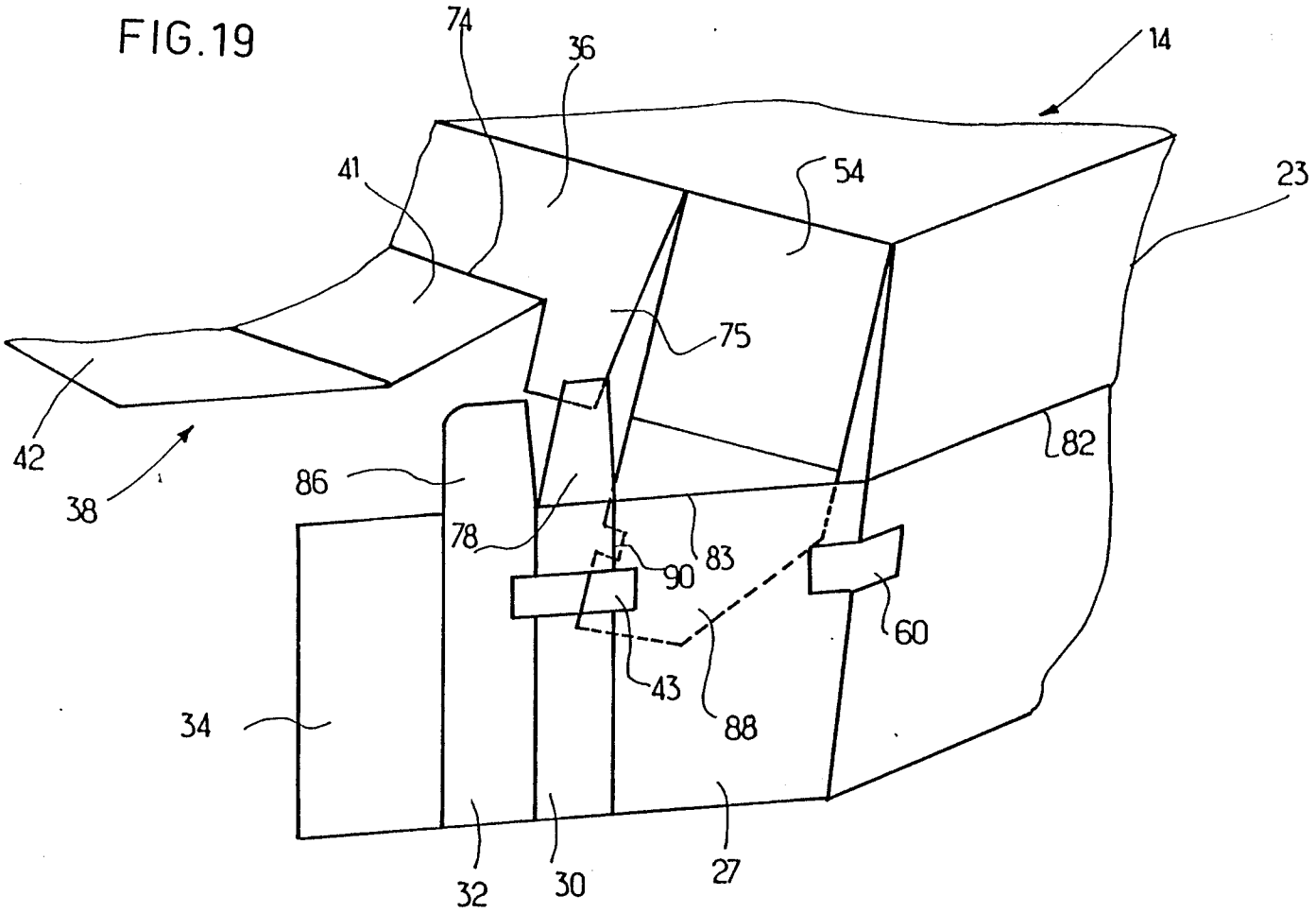
FIG. 19 is a detailed perspective view of a rectilinear part at the top of the cavity, with flaps being partially folded.
Figures 20, 21:
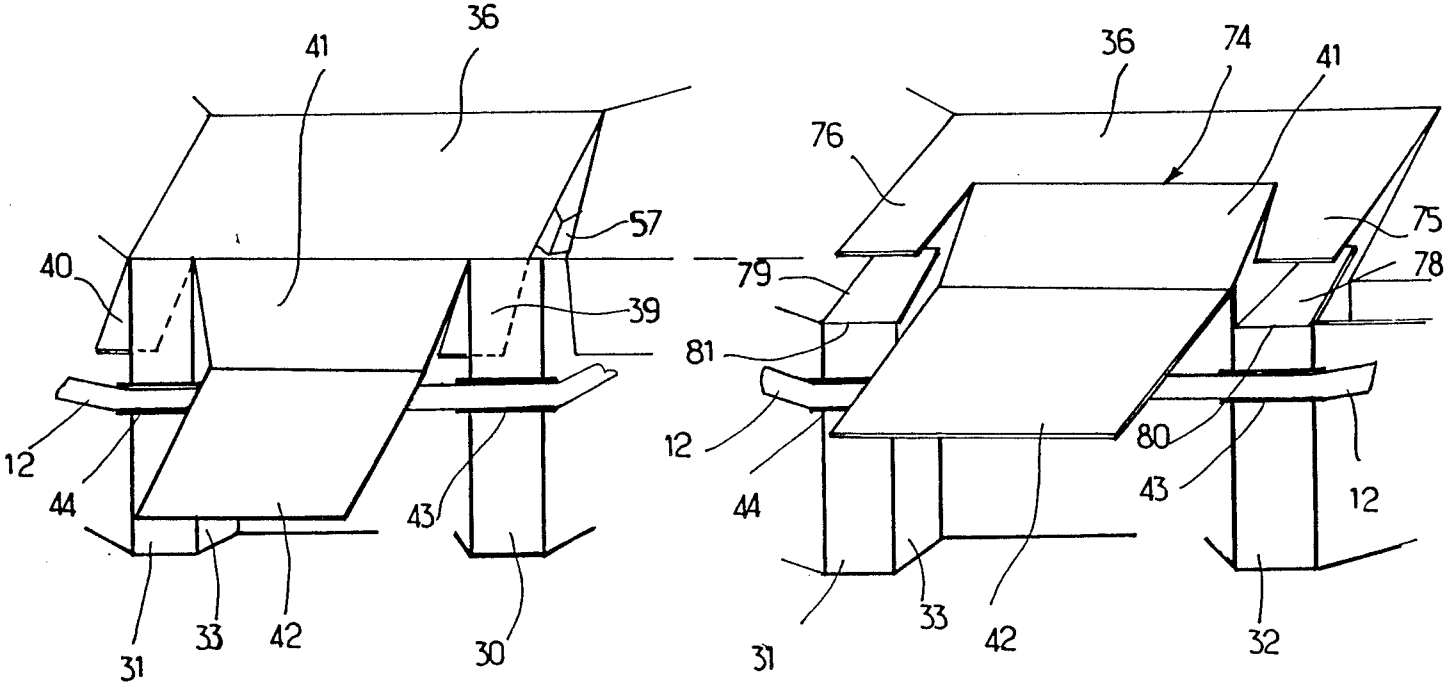
FIGS. 20 and 21 are two schematic perspective views from side to side, illustrating the displacement toward the top of the upper boundary of the cavit between the implementation of FIG. 7 and the version with the raised cavity of FIG. 18.
Figure 22:
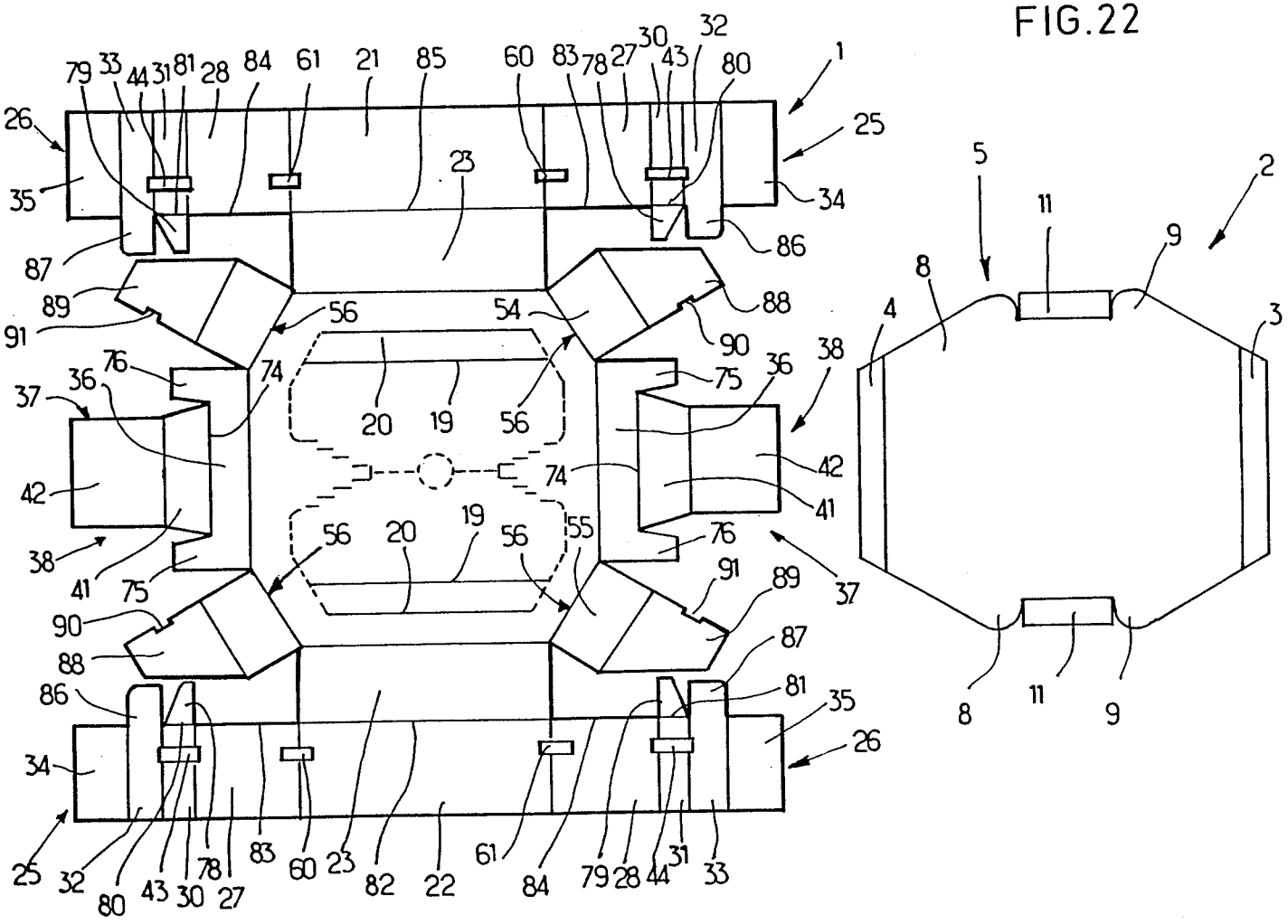
FIG. 22 is a plan view of the developed blanks of the body of the package and of its bottom, conforming to the variant illustrated in FIG. 11.

Of course, in order to accomplish in an industrial way the gluing of the body 1 of the package to the bottom 2, there have to be added one or two longitudinal grooves situated at the half-perimeter of the mounted package, as shown in dotted lines and identified as 72 and 73 in the plan view of FIG. 17.

These supplementary grooves permit the flattening of the body of the package.

One can also exploit a folding line or an existing groove. In this case, the position of the other groove is obtained by laterally offseting it by a half of the perimeter.

After the introduction of the grouping of containers, the lateral flaps are pushed towards the empty space and one then preceeds to lower the corner cut sections 54 and 55 and to the glue the strips 58 and 59 to the adjacent vertical oblique sections 27 and 28, then to the glue the lateral strips 39 and 40 of the upper tab 29, the immobilization tongue being still upward. The vertical bottom panels 34 and 35 of the cavity are then glued to the center bottom flap 11. The immobilizing tongue is then put down, positioned, glued and locked by the interaction of the lateral tongues and secondary notches.

For some kinds of bottles, especially those with shorter lengths of cylindrical necks, the inclination of the oblique lateral surface panels and, consequently, that of the oblique plane 36 of the front surface is augmented to such an extent that the joining groove between the vertical oblique planes of the vertical surface and, consequently, the boundary between the oblique plane 36 of the front surface and the corresponding vertical planes 30 and 31 approach the binding member too closely, thus offering only a minimal space for the passage of the hand.

According to a following characteristic, an appropriate configuration of the flat blank, realized in one or two pieces, and more particularly a modification of the succession of the sections, flaps, tongues and tabs constituting the upper part of the frontal surface again permits a sufficient raising of the upper boundary of the cavity (FIGS. 18 to 22).

In order to keep an opening wide enough for easy passage of the hand, the upper folding line 74 constituting the articulation of the immobilizing tongue 38 with the oblique joining section 36 can be raised by individualizing on the above-mentioned oblique section 36 two end extensions which will be referred to below as joining tongues 75 and 76. These tongues are longitudinally limited by the external longitudinal edges of the section 36 and the lateral edges of an opening 77 in that same section, in which the section constituting the main part of the passage is reserved for the hand of the consumer for access to the binding member.

The gluing strips situated, in the preceding versions, as extensions at various places of the oblique section 36, are identified here as 78 and 79, and are articulated, according to the present improvement at the panels 30 and 31 of the small end surface.

The folding lines 80 and 81 constituting these articulations are situated in the exact extension of the joining lines 82, 83, 84 and 85 between the longitudinal oblique sections 23, the cut corner panels 54 and 55 and the adjacent vertical panels 21, 22, 27, and 28 of the lateral surface.

The lowering of these folding lines in this type of package is a result of the particular shape of bottles provided with lowered shoulders.

This new configuration is characterized by the presence, in the extension of each vertical panel 39 and 31 of the lateral surface, of a stopping tongue 86 and 87 having a shape adapted to closing the opening delimited by the joining tongues 75 and 76 and the transversal edges of the oblique joining section 36.

The modification according to the present improvement is also characterized on the blank by the particular gluing strips 88 and 89, and by the cut corner panels 54 and 55. These strips shaped as trapezoids joined to rectangles are each provided with a notch 90 and 91 in order to keep the full opening for the passage of the binding member in the neighboring corresponding notches 43 and 44, thus permitting the binding member 12 to stay in direct and complete contact with the body of the bottles.

In addition, and in case of need, it is also and simultaneously possible to augment the depth of the cavity by augmenting the width of the cut lateral sections 32 and 33.

Finally, it is noted that it is possible in this realization to dispense with of all the bellows because of the particular shape of the blank and the semi-rigidity of the cardboard.

However, in some cases, for reasons of economic use of cardboard, it is desired to make the sides in a series of blanks juxtaposed transversely within the full format of the machine and then it is desired to reduce the length of the blanks in order to fit it totally in the width of the corresponding format of the particular machine.

These imperatives of economy are conducive to reduction in the lengths of the end panels of the blanks when it is flat, and which are the bottom panels of the grasping cavity.

The object of the improvement of the basic implementation is to remedy the problems caused by the necessity of saving, namely:

lower rigidity of the bottom realized with the same type of cardboard as the casing mandates a provision of a support at the end.

the shorter length of the end panels resulting from the considerations of saving on cardboard causes modification of the complexion of the cavity.

The above objectives are reached through the variant described below and presenting, in addition to the principal advantage of economic use of cardboard, the following complementary advantages:

easy assembly of the package increased rigidity mechanization facilitated both in the receptacle version as well as in the enveloping version called "wrap-around".

According to this variant which is applicable to a one-piece version as well as to a two piece version, the necessary adaptation dictated by the imperatives of economy is obtained, on one hand, by joining the bottom of the package which has become less rigid to the closest of its exterior edges by a central flap assuring the connection between the bottom of the grasping cavity and the bottom of the package and, on the other hand, by the realization of the bottom covering of the panels of the bottom of the cavity, which has become shorter, with the aid of the joining central flap but not any more on the lower level, near the bottom of the package, but at an intermediate level between the bottom of the package and the upper boundary of the bottom of the cavity.

More particularly, this improvement is characterized in that the bottom central flap present on each of the transverse sides of the bottom is connected according to a folding line situated in front of the bottom of the cavity, the bottom having at various parts of the central flap the auxiliary supporting strips that are held at the lower part to the lateral surface to provide a supplementary support.

Figure 29:
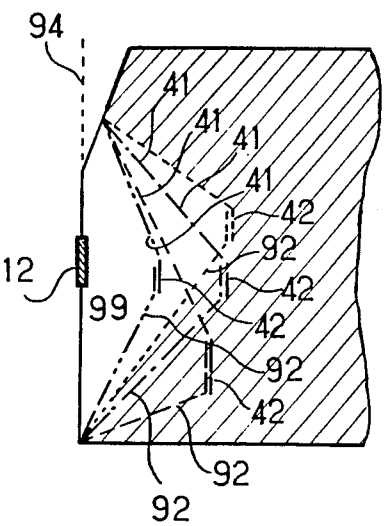
FIGS. 29 and 30 are two schematic vertical sectional views corresponding to FIGS. 27 and 28, respectively.
Figure 28:
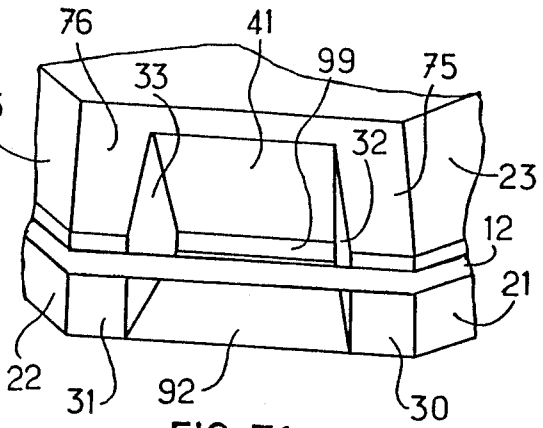
FIGS. 27 and 28 are illustrative diagrams of the possible variants with respect to the joining region of the bottom of the cavity to the bottom of the package corresponding to the implementation of FIG. 23.
Figure 27:
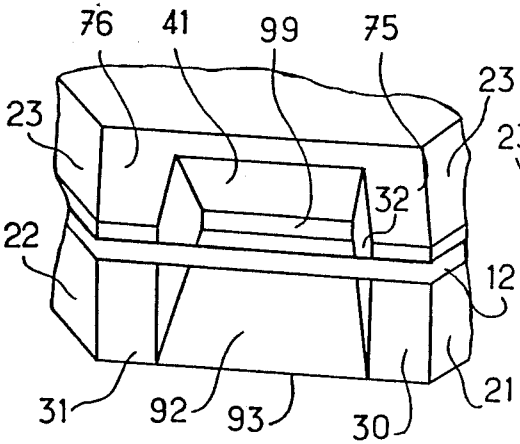
Figure 31:
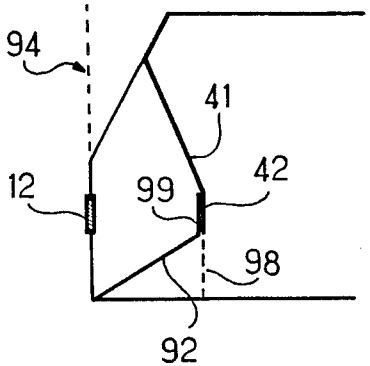
FIG. 31 is an illustrative vertical sectional view of the cavity showing several inclined positions of the panel joined with the bottom of the cavity.
Figure 30:
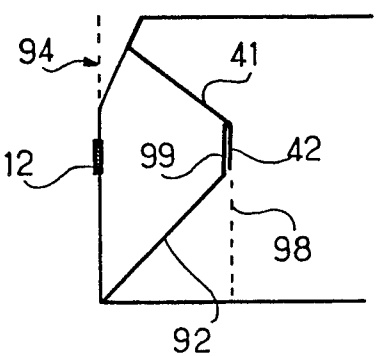

According to the present improvement shown in FIGS. 23 to 32, in order to provide a remedy for the lesser rigidity of the bottom 2, realized in the same blank of light-weight kraft cardboard, the bottom 2 is provided on each of the transverse sides with a central connecting flap 92 joined to the bottom according to a folding line 93 which is no longer situated in the extension of the bottom of the cavity 24 but rather in front of the bottom of the cavity, namely, in the entrance plane 94 of the cavity 24 which holds the peripheral binding member 12 shown in FIGS. 29 to 31.

Furthermore, the bottom 2 is provided on each side of the central connecting flap 92 with auxiliary supporting strips 95 and 96 connected at its lower part to the adjacent wall, preferably at the level of the vertical oblique sections 27 and 28, which is illustrated in the Figures, even though closer support might be necessary in some cases.

Figure 32:
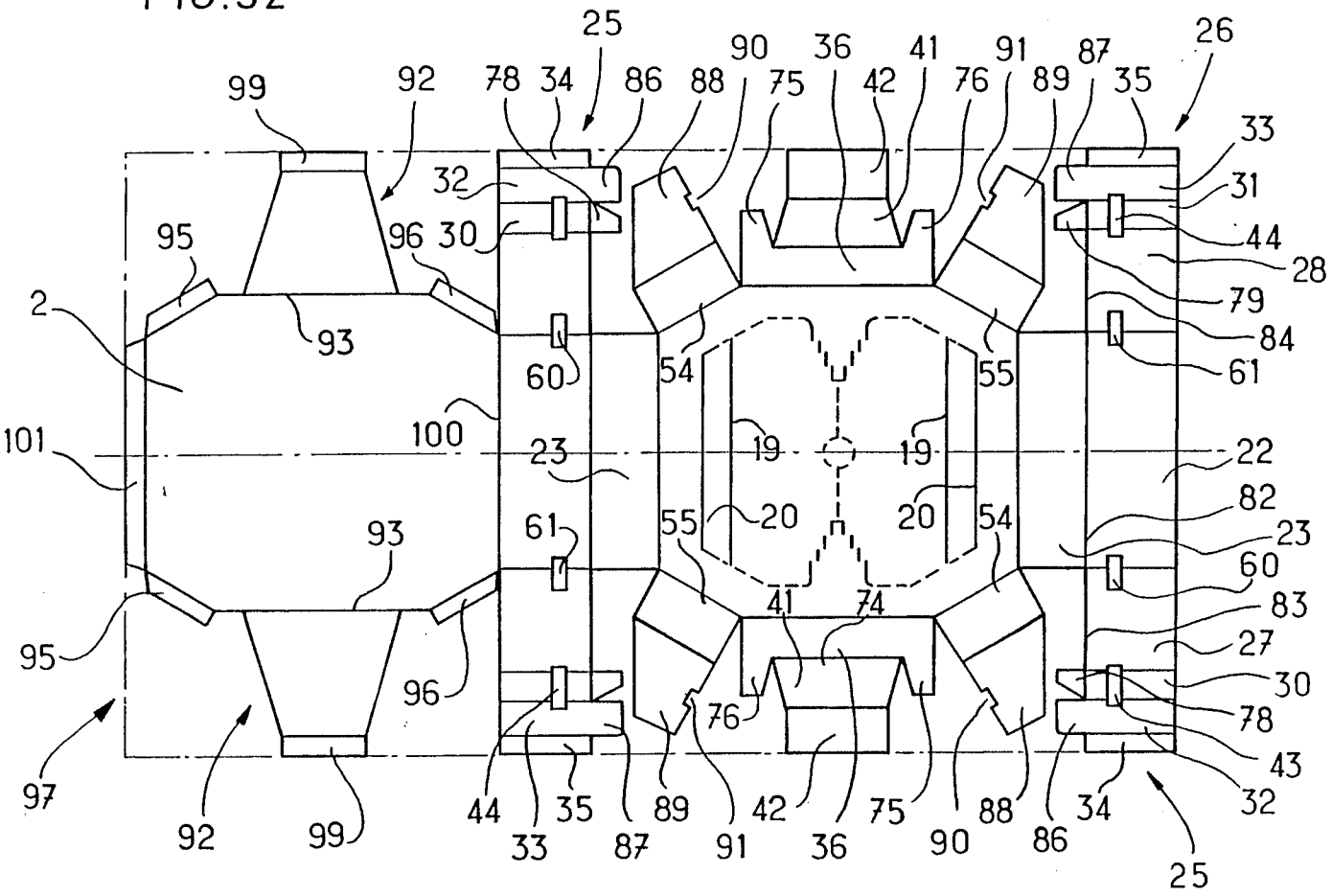
FIG. 32 is a general view of the developed blank corresponding to the implementation of FIG. 23.

Besides, in order to have the entire blank fit exactly on a width of a format 97 to be handled by a machine, it is depicted in FIG. 32 as a rectangle in dash-dotted lines and so as to then diminish the effect of any fall, it is desirable to reduce the end panels of the blank, that is, the width of the vertical bottom panels 34 and 35 of the cavity, as well as the length of the blocking flaps 41 and/or the locking flaps.

Thus the flaps 34 and 35 and 42 do not cover entirely the bottom surface of the cavity, leaving an opening 98 in the lower part of the bottom of the cavity.

In conformity with the present improvement, this opening 98 is hidden by the corresponding central connecting flap 92 of the bottom 2, articulated around the folding line 93 protruding toward the outside, preferably up to the opening 94 of the cavity containing the binding member 12.

This flap is reduced and furthermore blocked in an inclined plane by a joining strip 99 with which it is formed at the end thereof, being glued to the locking flap 42 in any position.

Its inclined position in a cavity of a trapezoidal section gives it a trapezoidal shape.

Of course, as is shown in FIGS. 27 to 31, according to the position of the binding member conditioned by the shape of the bottles and by the lengths of the flaps 41 and/ or 42 the zone of joinder of the central connecting flap 92, that is, its inclination and its length can noticeably vary.

The variations appear clearly in FIG. 31 which again shows diagrammatically certain positions seen in section.

An example of mounting of the end structures will now be described with reference to FIGS. 24 to 26.

The upper part of the flat blank is placed over a group of containers which have been first put on the bottom by bending around the joining groove 100 of the large adjacent lateral surface, in the case of a blank delivered as a flat blank.

A receptacle is then made by the gluing of the holding strip 101 of the bottom 2. Then the movements of folding over of the various flaps called for to form each small end face and particularly the cavity 24 are started.

Figure 24:
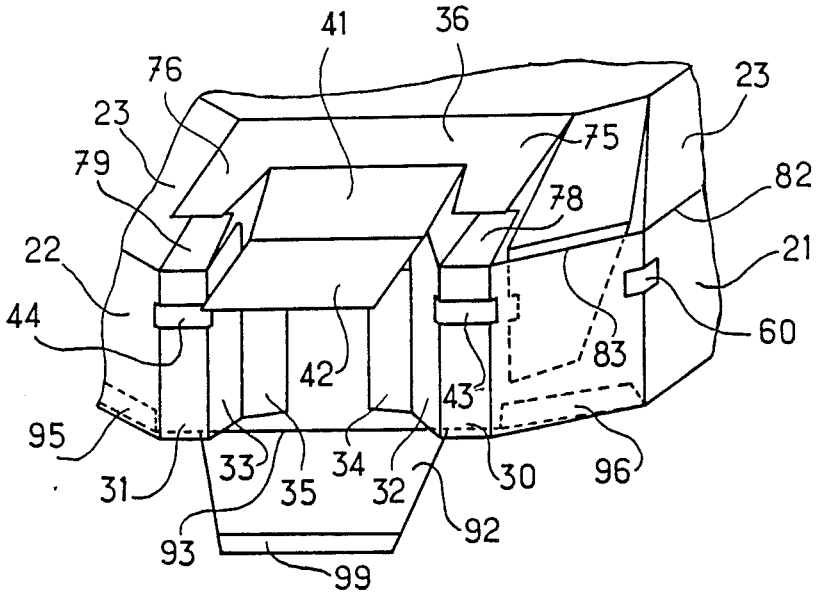
FIG. 24 is a perspective view of an end corresponding to the implementation of FIG. 23 with a gripping cavity which is partially closed.

The panels 30 and 31 of the small end surfaces, the lateral cut sections 32 and 33, as well as the vertical panels 34 and 35 of the bottom of the cavity are folded over (FIG. 24).

Figure 25:
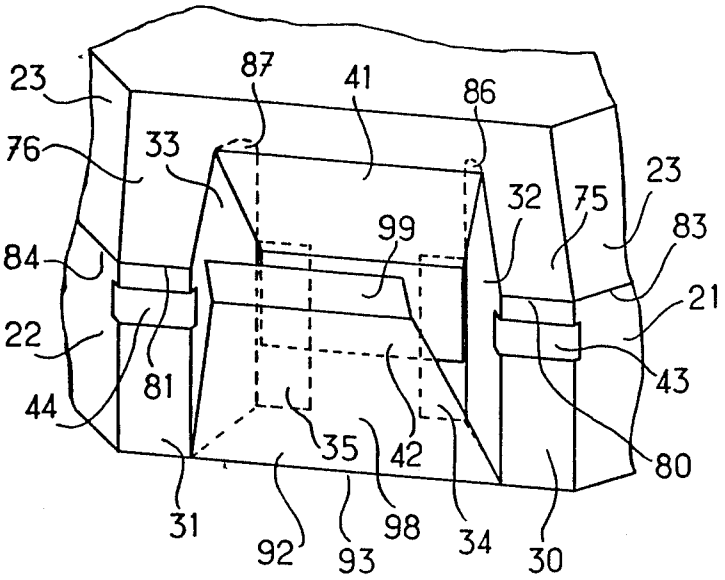
FIG. 25 is a perspective view of an end corresponding to the implementation of FIG. 23 with a gripping cavity at the end of its formation.

Then, the blocking and locking flaps 41 and 42 are folded; followed by the central flaps 92 of the bottom 2 and then there is effected the connection of the auxiliary supporting strips 95 and 96 (FIG. 25).

The flap 42 is glued to the panels 34 and 35 of the bottom of the cavity and the central connecting flap 92 of the bottom hides the lower part and is connected to the flap 42 at any height from the bottom of the cavity by its joining strip 99 which closes the zone of the opening 98.

Figure 23:
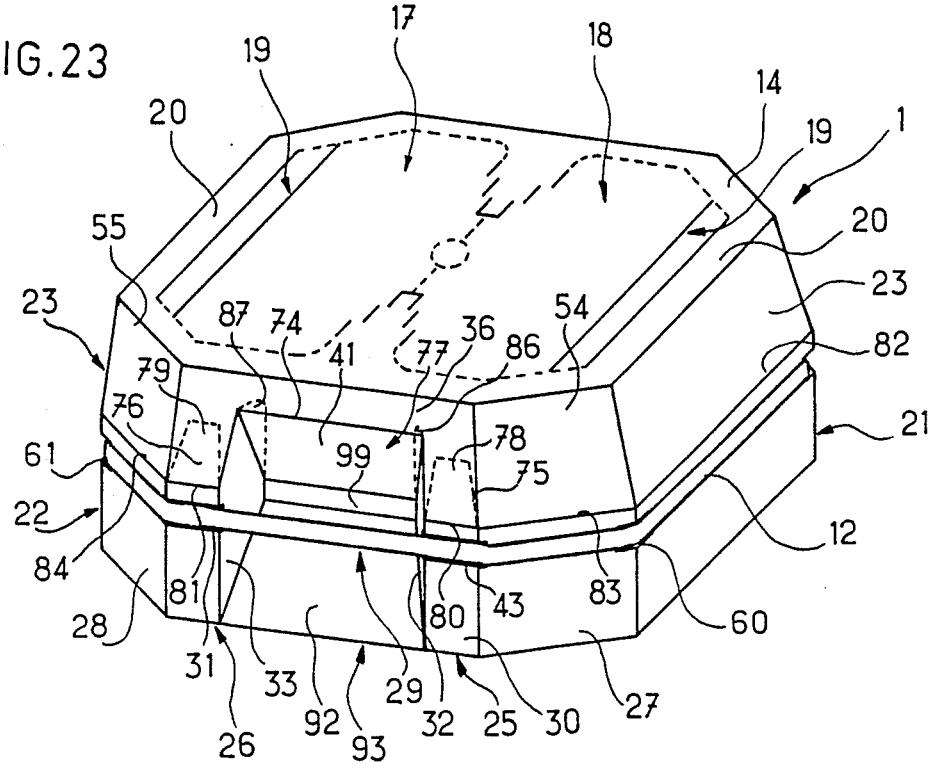
FIG. 23 is a perspective view of a variant having a gripping cavity with a bottom support.
Figure 26:
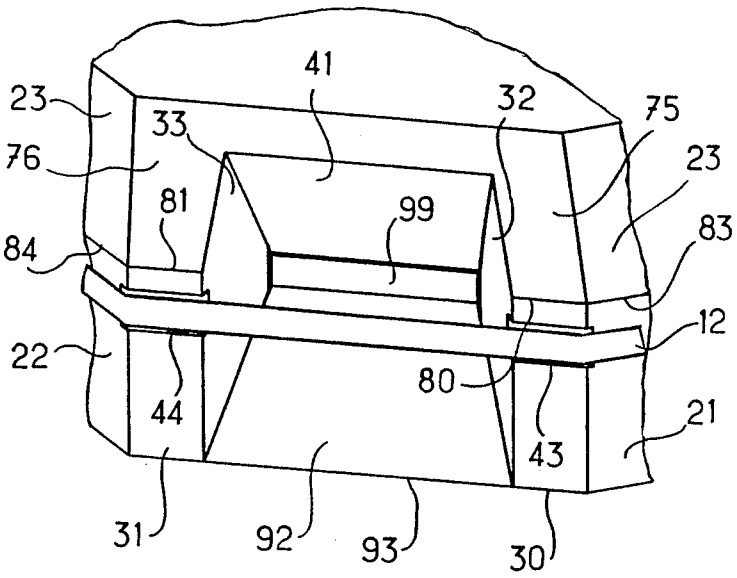
FIG. 26 is a perspective view of an end corresponding to the implementation of FIG. 23 which is completely assembled.

The assembly is then encircled and the package is completely constituted for dispatch to distributing channels (FIGS. 23 and 26).

The present invention is subject to variations and simple and direct modifications without departing in any way from its framework.

Even though the invention has been described with respect to a particular implementation, it will be understood that it is not to be limited and that diverse modifications of secondary order without inventive contribution are completely embraced within its framework.

I claim:

1. A package for accomodating a plurality of containers, comprising a body having an upper panel, lateral panels spaced from one another and connected with said upper panel, and end panels spaced form one another and connected with said upper panel, each of said lateral panels being connected with a respective one of said end panels through a corner which is provided with a notch;

a bottom connectable with said body so as to completely close the package; and a binding member extending over a periphery of said body and engaging in said notches of said corners of said body, said binding member being also formed as a handle, at least one of said end panels of said body being formed with an inner cavity as seen from the exterior, so that containers can be accommodated in the package in multiple rows of containers extending between said end panels, and wherein at least one row adjoining said inner cavity near a center thereof has fewer containers than at least another row also extending between said end panels, but being free from adjoining said inner cavity near the center thereof, and so that a passage is formed between at least a part of said one end panel and said binding member for grasping said binding member, and said bottom being formed in the region of said cavity with a shape which corresponds to a shape of said cavity.

2. Package according to claim 1, wherein said bottom has two lateral flaps connected with said lateral panels of said body and two transverse edges, at least one of said transverse edges of said bottom having a central flap connected with said one end panel of said body, and two portions located at opposite sides of said central flap.

3. Package according to claim 2, wherein said portions of said one transverse edge of said bottom are substantially semi-cylindrical.

4. Package according to claim 2, wherein said portions of said one transverse edge of aid bottom have the shape of broken lines.

5. Package according to claim 1, wherein the other of said end panels of said body is also formed with another such inner cavity, said bottom being formed in the region of the other cavity with a shape which corresponds to a shape of said other cavity.

6. Package according to claim 1, wherein said one end panel provided with said inner cavity includes an upper tab which forms an extension of said upper panel of said body, and two lateral tabs each forming an extension of a respective one of said lateral panels of said body.

7. Package according to claim 6, wherein each of said lateral tabs has a first lateral tab portion connected with one of said lateral panels and forming an end face of the package, a second lateral tab portion connected with said first lateral tab portion and forming a lateral wall of said cavity, and a third lateral tab portion connected with said second lateral tab portion and forming a bottom of said cavity, said third lateral tab portions of said two lateral tabs being applied over one another.

8. Package according to claim 7, wherein said bottom has two transverse edges, at least one of said transverse edges having a central flap which is applied over and connected with said third lateral tab portions of said two lateral tabs of said body.

9. Package according to claim 8; and further comprising means for connecting said third lateral tabs portions of said lateral tabs of said body with said central flap of said bottom and including glue.

10. Package according to claim 7, wherein said upper tab has a first oblique upper tab portion connected with said upper panel, an immobilizing tongue extending from a central part of said first oblique upper tab portion and including a first blocking flap having a trapezoidal shape and a locking flap having a rectangular shape and connected with at least one of said third lateral tab portions which form said bottom of said cavity, and two lateral connecting strips extending from said first oblique tab portion at both sides of said immobilizing tongue and covered by said first lateral tab portions of said lateral tabs.

11. Packages according to claim 10; and further comprising means for connecting said locking flap with said one third lateral tab portion and including glue.

12. Package according to claim 10, wherein said lateral tabs have notches at least one of said first blocking flap and said locking flap having lateral immobilizing projections cooperating with said notches of said lateral tabs.

13. Package according to claim 12, wherein both said first blocking flap and said locking flap have such lateral immobilizing projections cooperating with said notches.

14. Package according to claim 10, and further comprising an oblique lateral portion connecting each of said lateral panels with said upper panel; and an oblique lateral tab portion connecting each of said lateral tabs with a respective one each of said lateral tabs with a respective one of said lateral panels, said oblique upper tab portion, said oblique lateral tab portions, and said oblique lateral portions being articulately connected with each other.

15. Package according to claim 14, and further comprising means for articulately connecting said oblique upper tab portion, said oblique lateral tab portions, and said oblique lateral portions with each other and including two trihederal hollow pyramid members each including three substantially triangular panel sections connected with one another.

16. Package according to claim 14, and further comprising means for articulately connecting said oblique upper tab portion, said oblique lateral tab portions, and said oblique lateral portions with each other and including two members each having a corner cut section and a guiding strip connecting said corner cut section with a respective one of said oblique lateral tab portions.

17. Package according to claim 16, wherein each of said oblique lateral tab portions is suppressed at a predetermined location, and ridge is provided at said location.

* * * * *